US008695971B2

(12) United States Patent
Sekiyama et al.

(10) Patent No.: US 8,695,971 B2
(45) Date of Patent: Apr. 15, 2014

(54) SHEET PROCESSING APPARATUS AND IMAGE FORMING APPARATUS

(75) Inventors: Junichi Sekiyama, Tokyo (JP); Masayoshi Fukatsu, Suntou-gun (JP); Atsushi Ogata, Mishima (JP); Hiroharu Tsuji, Numazu (JP); Yuri Yoshimura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 12/842,891

(22) Filed: Jul. 23, 2010

(65) Prior Publication Data

US 2011/0024973 A1 Feb. 3, 2011

(30) Foreign Application Priority Data

Jul. 30, 2009 (JP) ..... 2009-177408
Jul. 12, 2010 (JP) ..... 2010-158043

(51) Int. Cl.
*B65H 29/34* (2006.01)

(52) U.S. Cl.
USPC ..... 271/189; 271/220; 271/221; 271/306

(58) Field of Classification Search
USPC ..... 271/184, 185, 189, 192, 220, 221, 222, 271/223
See application file for complete search history.

(56) References Cited

U.S. PATENT DOCUMENTS

| | | | | |
|---|---|---|---|---|
| 6,832,759 | B2 * | 12/2004 | Nagasako et al. | 271/222 |
| 6,942,206 | B2 | 9/2005 | Kuwata | |
| 7,344,131 | B2 * | 3/2008 | Terao et al. | 270/58.08 |
| 7,406,293 | B2 * | 7/2008 | Terao et al. | 399/405 |
| 2009/0026696 | A1 * | 1/2009 | Ogata et al. | 271/220 |
| 2009/0066003 | A1 * | 3/2009 | Kunieda et al. | 271/3.02 |
| 2009/0146369 | A1 * | 6/2009 | Yoshimura et al. | 271/207 |

* cited by examiner

*Primary Examiner* — Michael McCullough
*Assistant Examiner* — Howard Sanders
(74) *Attorney, Agent, or Firm* — Canon U.S.A., Inc. IP Division

(57) ABSTRACT

In a sheet processing apparatus, a pair of regulating members is provided at a pair of joggers so that the regulating members are movable together with the joggers. When the pair of joggers is laterally moved, the pair of regulating members also laterally moves together with the pair of joggers. By moving the pair of joggers to passage positions, the pair of regulating members regulates the lateral ends of a sheet, which falls and is stacked on a first stacking tray.

22 Claims, 24 Drawing Sheets

150
151
152
153
155
156
158
32
33

SHEET PROCESSING APPARATUS AND IMAGE FORMING APPARATUS

BACKGROUND OF THE INVENTION

1. Field of the Invention

The present invention relates to a sheet processing apparatus and an image forming apparatus. More particularly, the present invention relates to a sheet processing apparatus enabling the miniaturization and cost reduction, and improving the sheet alignment performance.

2. Description of the Related Art

Conventionally, commonly known image forming apparatuses such as copying machines, printers, facsimiles, and multifunction peripherals include an image forming apparatus main body and a sheet processing apparatus for processing sheets. The image forming apparatus main body includes an image forming portion. An image is formed on a sheet in the image forming portion and then the sheet is conveyed to the sheet processing apparatus.

Some of such sheet processing apparatuses include a sheet stacking tray, an intermediate stacking portion disposed above the sheet stacking tray, and a pair of joggers for supporting and aligning the ends in width direction perpendicular to the sheet conveyance direction (hereinafter referred to as lateral ends) of a sheet stack on the intermediate stacking portion. A stapler for performing stapling process to the sheet stack is provided in the vicinity of the intermediate stacking portion.

The above-mentioned sheet processing apparatus can be set either in the stapling process mode in which the stapler performs stapling process to the sheet stack on the intermediate stacking portion, or in the stack mode in which sheets are discharged onto the sheet stacking tray one by one without stapling process. To pursue the miniaturization, cost reduction, usability, and aligning performance, the joggers for aligning the lateral ends of the sheet by movement of the pair of joggers in width direction are not disposed in the sheet processing apparatus main body but disposed downstream in the sheet conveyance direction of sheet discharge rollers (refer to U.S. Pat. No. 6,942,206).

When the sheet processing apparatus is set in the stapling process mode, sheets are sequentially conveyed to the intermediate stacking portion and the pair of joggers, the lateral ends of the sheet stack are supported by the joggers, and after the sheet stack is subjected to stapling process by the stapler, the sheet stack is dropped onto the sheet stacking tray from the intermediate stacking portion by retraction of the pair of joggers in width direction.

The sheet processing apparatus performs stapling process for target sheets separated from the sheet stack on the sheet stacking tray in this way, instead of performing it on the sheet surface of the sheet for a preceding job stacked on the sheet stacking tray. Thus, the sheet stack on the sheet stacking tray can be taken out during stapling process, improving the accessibility to the sheet.

Further, the sheet processing apparatus is provided with a space between the sheet stacking tray and the joggers so that the space makes a sheet stack easy to take out from the sheet stacking tray. When the sheet processing apparatus is set in the stack mode, a discharged sheet from the sheet discharge rollers is passed between the pair of joggers retracted to outward positions in a sheet discharge area and dropped onto the sheet stacking tray directly.

However, the above-mentioned conventional configuration has a problem that, when the sheet processing apparatus is set in the stack mode in which sheets are stacked on the sheet stacking tray one by one without stapling process, the sheets are likely to become disordered resulting in degraded sheet alignment performance.

Since a single sheet is light, the sheet fluctuates due to air resistance while it is falling over a long distance from a sheet discharge port to the sheet stacking tray. Therefore, there has been a demand for a sheet processing apparatus that can improve the sheet alignment performance for a single sheet, with a simple configuration and low cost.

SUMMARY OF THE INVENTION

According to an aspect of the present invention, a sheet processing apparatus includes a conveyance portion configured to convey a sheet, a pair of supporting members movable to supporting positions for supporting the conveyed sheet and to passage positions for enabling passage of the conveyed sheet, a stacking portion disposed under the pair of supporting members, and configured to stack a sheet supported by the pair of supporting members and a sheet that has passed between the pair of supporting members positioned at the passage positions, and a pair of regulating members disposed at the pair of supporting members, and configured to regulate the ends of a sheet falling onto the stacking portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A copying machine will be described below as an exemplary image forming apparatus. The exemplary image forming apparatus may be a printer, a facsimile machine, or a multifunction peripheral.

Figure 1:
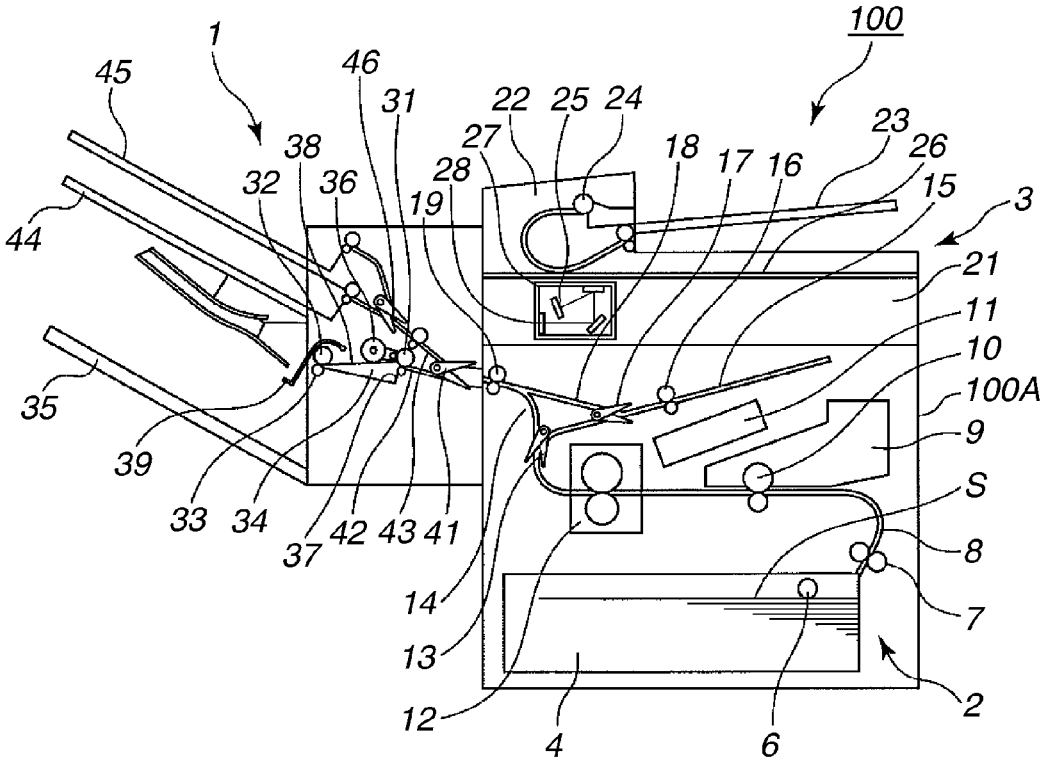
FIG. 1 illustrates an overall configuration of a copying machine as an exemplary image forming apparatus according to a first exemplary embodiment of the present invention.

FIG. 1 illustrates an overall configuration of a copying machine as an exemplary image forming apparatus according to a first exemplary embodiment of the present invention.

A copying machine 100 includes a copying machine main body 100A and an image reading portion 3 disposed at the upper part of the copying machine main body 100A to read a document image. Further, the copying machine 100 includes a sheet processing apparatus 1 disposed downstream in the sheet conveyance direction of the copying machine main body 100A to perform a predetermined process such as stapling process to sheets conveyed from the copying machine main body 100A. Although the sheet processing apparatus 1 may be included in the copying machine main body 100A, the present exemplary embodiment will be described below based on cases where it is externally attached to the copying machine main body 100A.

The image reading portion 3 includes a scanner unit 21 and an automatic document feeder (ADF) 22. The scanner unit 21 is provided with a movable optical carriage 27 to read information on a document. With the ADF 22, feed rollers 24 separate and feed one by one a plurality of sheets stacked on a document feeder tray 23, and then cause each sheet to pass over a document reading position 25 at which the optical carriage 27 of the scanner unit 21 is positioned.

The ADF 22 can be posteriorly opened and closed centering on a hinge (not illustrated) disposed at the posterior of the copying machine main body 100A. When a document is placed on a document positioning glass plate 26, the ADF 22 can be opened and closed.

The scanner unit 21 reads information on the document by horizontally moving the optical carriage 27 to scan the document placed on the document positioning glass plate 26, and performs photoelectric conversion by using a charge-coupled device (CCD) 28. During the above-mentioned document reading process by the ADF 22, the optical carriage 27 stops at the document reading position 25 to read information on the document being conveyed.

The copying machine main body 100A of the copying machine 100 includes a sheet feeder 2, and an image forming process unit 9 and a fixing device 12 as an image forming portion for forming an image on a sheet. With the sheet feeder 2, a feed roller 6 and a separation-conveyance roller pair 7 separate and feed one by one a plurality of sheets S stored in a sheet cassette 4, and a conveyance guide 8 conveys each sheet to the image forming process unit 9.

The image forming process unit 9 includes a photosensitive drum 10 as an image bearing member to form an image (toner image) through the electrophotographic process. Specifically, the charged photosensitive drum 10 is irradiated with a laser beam from a laser scanner 11 to form an image on the electrified photosensitive drum 10. The image is developed using toner to form a toner image, and the toner image is transferred to a sheet S.

The sheet S on which the toner image has been transferred from the photosensitive drum 10 is conveyed to the fixing device 12. The fixing device 12 applies heat and pressure to the sheet S to fix the image thereon. The sheet S with the image fixed thereon is conveyed to either a face-up conveyance path 14 or a switchback conveyance path 15 for reversing the upper and lower sides of the sheet S by a conveyance path changeover member 13.

When the sheet S is conveyed to the switchback conveyance path 15, it is further conveyed by a switchback conveyance roller pair 16 until the trailing edge of the sheet S passes over a reversing member 17. Then, when the rotation of the switchback conveyance roller pair 16 is reversed, the trailing edge of the sheet S becomes the leading edge and the sheet S is conveyed with the upper and lower sides reversed, i.e., the image forming side facing the lower side.

At this timing, the reversing member 17 changes to the lower position to convey the reversed sheet S to a face-down conveyance path 18. The face-up conveyance path 14 and the face-down conveyance path 18 join together before a discharge roller pair 19.

Both the sheet S guided to the face-up conveyance path 14 and the sheet S that has passed through the face-down conveyance path 18 from the switchback conveyance path 15 are discharged from the copying machine main body 100A by the discharge roller pair 19.

Figure 2:
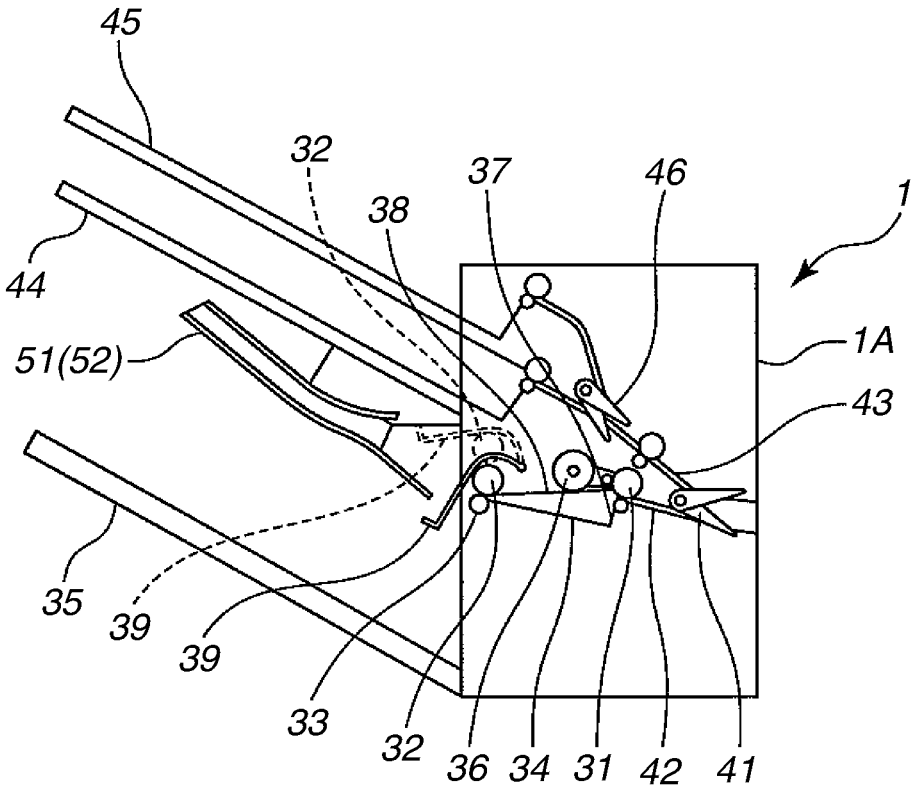
FIG. 2 illustrates an overall configuration of a sheet processing apparatus.
Figure 3:
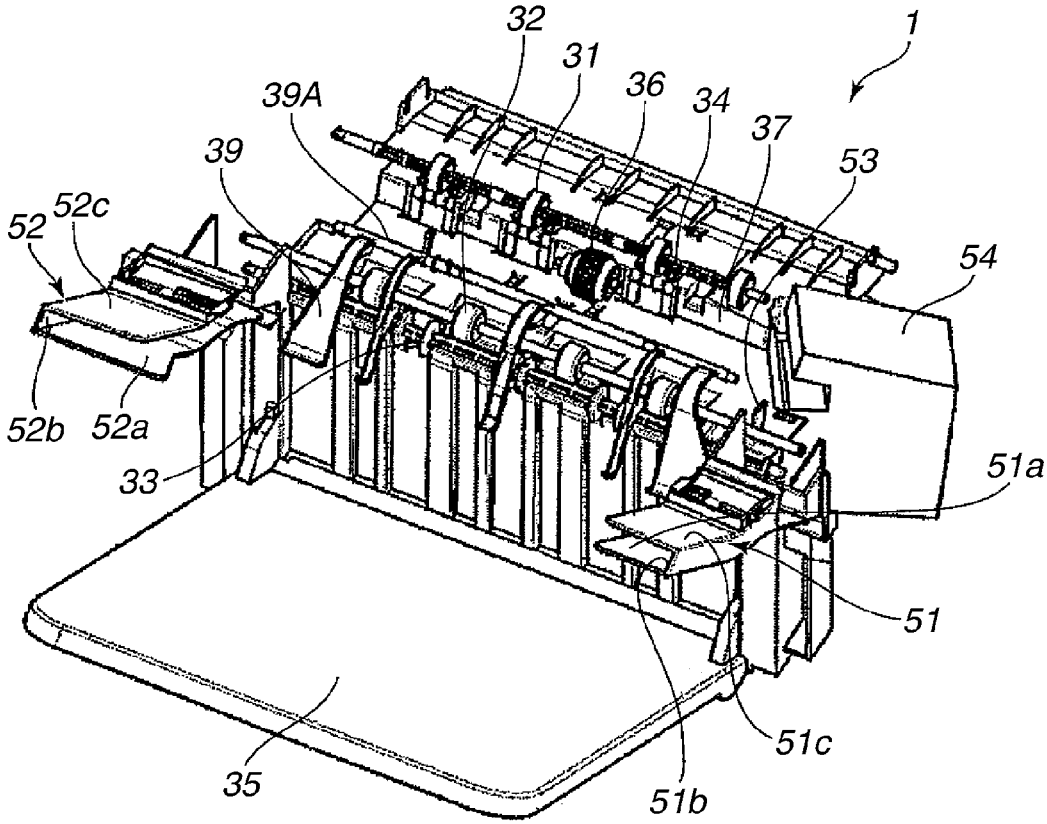
FIG. 3 is a perspective view illustrating a partially omitted overall configuration of an essential part of the sheet processing apparatus.

FIG. 2 illustrates an overall configuration of the sheet processing apparatus 1. FIG. 3 is a partially omitted perspective view illustrating an overall configuration of an essential part of the sheet processing apparatus 1.

The sheet processing apparatus 1 sequentially receives the sheets S discharged from the copying machine main body 100A by the discharge roller pair 19, and performs stapling process to the sheets S. The configuration of the sheet processing apparatus 1 will be described below.

As illustrated in FIG. 2, the sheet processing apparatus 1 includes intermediate conveyance rollers 31 as sheet conveyance components for conveying a sheet, and an intermediate stacking portion 34 disposed downstream in the sheet conveyance direction of the intermediate conveyance rollers 31 to support the upstream side of the sheet conveyed by the intermediate conveyance rollers 31. The sheet processing apparatus 1 further includes a plurality of pairs of upper and lower discharge rollers (upper discharge rollers 32 and lower discharge rollers 33) disposed downstream in the sheet conveyance direction of the intermediate stacking portion 34 to enable discharging the sheet from a sheet processing apparatus main body 1A.

The pairs of discharge rollers 32 and 33 are configured to contact and separate from each other. In the present exemplary embodiment, the upper discharge rollers 32 are configured to contact and separate from the lower discharge rollers 33. The pairs of discharge rollers 32 and 33 are formed like comb teeth or in staggered pattern so as to be alternately interleaved. At a contact position, they are overlapped with each other. Thus, when the sheet is discharged by the pairs of discharge rollers 32 and 33, the sheet has high rigidity in a state of curvature.

As illustrated in FIG. 3, a stapler 54 is disposed at one lateral end of the intermediate stacking portion 34. The stapler 54 performs stapling process to a sheet stack. Joggers 51 and 52 are disposed at the outside of the sheet processing apparatus main body 1A to support the downstream side of a sheet conveyed by the intermediate conveyance rollers 31 and align the lateral ends of the sheet.

The joggers 51 and 52 (specifically, sheet supporting portions composed of the joggers 51 and 52 as supporting members and the intermediate stacking portion 34) support the sheet stack to enable the stapler 54 to perform stapling process thereto.

The joggers 51 and 52, formed as a pair of aligning members, are disposed at both lateral ends of a sheet, downstream in the sheet conveyance direction by the pairs of discharge rollers 32 and 33. Each of the joggers 51 and 52 has a cross-sectional shape of lying squarish letter U and an opening side facing each other. The joggers 51 and 52 are configured to laterally move.

The joggers 51 and 52 have sheet supporting surfaces 51*a* and 52*a* for supporting a sheet, sheet aligning surfaces 51*b* and 52*b* perpendicularly extending from the sheet supporting surfaces 51*a* and 52*a*, and guide surfaces 51*c* and 52*c* disposed above and facing the sheet supporting surfaces 51*a* and 52*a*, respectively.

A first alignment reference wall 37 for aligning an end upstream in the sheet conveyance direction (hereinafter referred to as upstream end) of the sheet is formed on the intermediate stacking portion 34. An alignment roller 36 is disposed above the intermediate stacking portion 34 and configured to contact and separate from (to be lowered to and elevated from) the sheet stacking surface of the intermediate stacking portion 34. When the alignment roller 36 is elevated, the sheet can be conveyed to the intermediate stacking portion 34 by the intermediate conveyance rollers 31.

When the alignment roller 36 is lowered, the alignment roller 36 contacts the upper surface of the sheet stacked on the intermediate stacking portion 34, and moves the sheet toward the upstream in the sheet conveyance direction. In this state, the sheets can be aligned in the sheet conveyance direction by pushing the upstream end of the sheet against the first alignment reference wall 37. Downstream in the sheet conveyance direction in the vicinity of the stapler 54, a second alignment reference wall 53 perpendicularly extends from the sheet stacking surface of the intermediate stacking portion 34.

The jogger 51, one of the pair of joggers 51 and 52, serves as a reference side jogger. The jogger 52, the other of the pair, serves as an alignment side jogger. Specifically, the jogger 51 moves to a reference position for aligning the sheet aligning surface 51*b* with the second alignment reference wall 53 in a direction parallel to the sheet conveyance direction. In this state, the jogger 52 is moved toward the jogger 51 to align the lateral ends of a plurality of sheets stacked on the intermediate stacking portion 34. Thus, the product of stapling process can be neatly finished. Referring to FIG. 2, the intermediate stacking portion 34 has an upper conveyance guide 38.

A first stacking tray 35 is obliquely disposed under the pair of joggers 51 and 52 serving as a stacking portion. A sheet bundle subjected to the stapling process and discharged or a sheet without stapling process directly discharged by the pairs of discharge rollers 32 and 33 falls and stacks on the first stacking tray 35.

As illustrated in FIG. 3, between the pair of joggers 51 and 52, downstream in the sheet conveyance direction of the pairs of discharge rollers 32 and 33, five full-state detection sensor levers 39, as laterally arranged full-state detection members, are supported to be independently rotatable to each other.

The full-state detection sensor levers 39 contact the upper surface of the sheets stacked on the first stacking tray 35 to detect that the sheet stack has reached a predetermined height, and to determine the full state.

Specifically, a rotating shaft 39A of the full-state detection sensor levers 39 is disposed above the upper discharge rollers 32, upstream in the sheet conveyance direction. Each of the full-state detection sensor levers 39 is formed in such a manner that it goes over a roller shaft of the upper discharge rollers 32 and is downwardly curved. When the full-state detection sensor levers 39 contact the upper surface of the sheets stacked on the first stacking tray 35, they are upwardly rotated according to the amount of sheet stack. When the height of the upper surface of the sheet stack reaches a predetermined height, rotational positions of the full-state detection sensor levers 39 are detected by respective photo sensors (not illustrated).

Outside of the sheet processing apparatus main body 1A, a second stacking tray 44 and a third stacking tray 45 are disposed above the pair of joggers 51 and 52. A changeover member 41 is disposed at a sheet entrance of the sheet processing apparatus main body 1A to convey the sheets to the second stacking tray 44 and the third stacking tray 45. By changing the direction of the changeover member 41, a sheet having been conveyed to the sheet processing apparatus 1 is further conveyed to either a stapling conveyance path 42 or a distribution conveyance path 43.

A distribution member 46 is disposed on the distribution conveyance path 43 to distribute a sheet either to the second stacking tray 44 or to the third stacking tray 45. Then, the sheet is discharged and stacked on either stacking tray by respective discharge rollers.

The present exemplary embodiment has two different modes such as the stapling process mode in which a sheet stack is subjected to stapling process and then discharged onto the first stacking tray 35, and the stack mode in which a sheet is directly discharged onto the first stacking tray 35 without stapling process. Each mode is selectively set by a user operation on an operation portion (not illustrated).

The pair of joggers 51 and 52 operates differently in each mode. The operation of the pair of joggers 51 and 52 will be described in detail below.

Figure 4A:
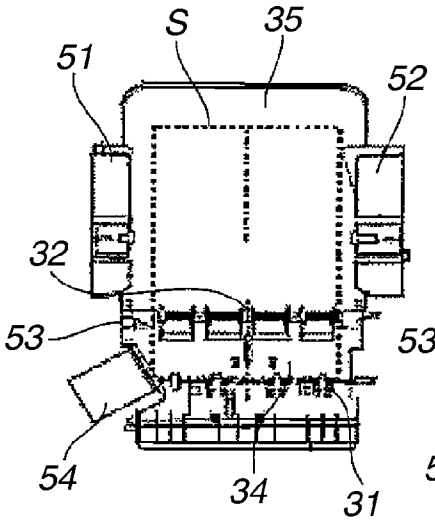
FIGS. 4A to 4D illustrate movement positions of a pair of joggers.
Figure 4B:
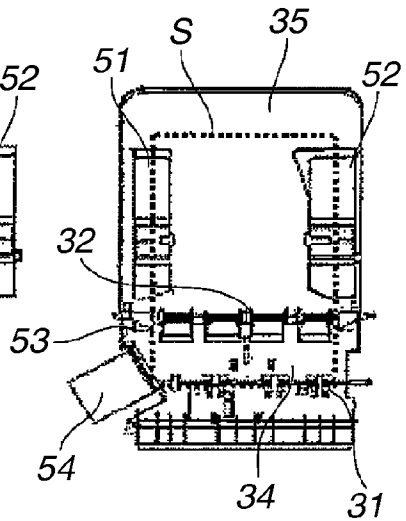

FIGS. 4A and 4B illustrate movement positions of the pair of joggers 51 and 52. FIG. 4A illustrates a state where the pair of joggers 51 and 52 has moved to passage positions for dropping a sheet S onto the first stacking tray 35 without supporting the joggers. FIG. 4B illustrates a state where the pair of joggers 51 and 52 has moved to receiving positions for receiving a sheet in the stapling process mode.

Figure 4C:
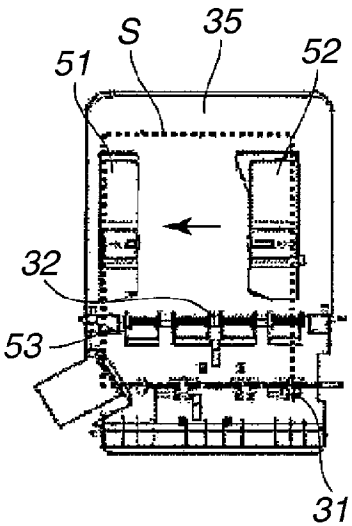
Figure 4D:
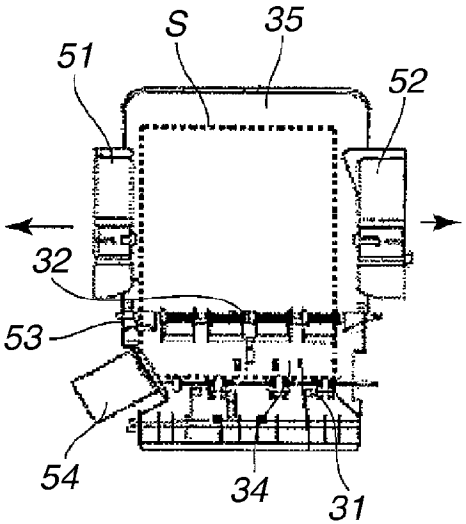

FIG. 4C illustrates a state where the pair of joggers 51 and 52 is moving to alignment positions for aligning the lateral ends of a sheet stack in the stapling process mode. FIG. 4D illustrates a state where the pair of joggers 51 and 52 has dropped a sheet bundle bound by stapling process and is moving to the retracting positions in the stapling process mode.

Specifically, when the sheet processing apparatus 1 is set in the stack mode, the pair of joggers 51 and 52 separates from each other more than the length of the sheet in the width direction and moves to the passage positions, as illustrated in FIG. 4A. In this state, the sheet passes through the joggers.

When the sheet processing apparatus 1 is set in the stack mode, the sheet S is conveyed with reference to the center of the sheet in the width direction (hereinafter referred to as center reference), and discharged onto the first stacking tray 35 on a center reference basis. Specifically, in the stack mode, the sheet S is not stacked on the pair of joggers 51 and 52 and therefore sheets are discharged one by one onto the first stacking tray 35 on a center reference basis. In the stack mode, the sheet S of any size is discharged onto the first stacking tray 35 on a center reference basis.

Although the sheet S is discharged while slightly being interfered by a projection at the leading edge of the jogger 52, the jogger 52 has a curved shape when viewed from the lateral side allowing the sheet toward the projection in height direction when viewed from the lateral side. In other words, since the projection of the jogger 52 is disposed above the discharge sheet surface with respect to the sheet discharge angle when viewed from the lateral side, the sheet can avoid the projection.

When the sheet processing apparatus 1 is set in the stapling process mode, the joggers 51 and 52 move to the receiving positions, as illustrated in FIG. 4B. When the joggers 51 and 52 are positioned at the receiving positions, they sequentially receive the sheets conveyed by the intermediate conveyance rollers 31 to form a sheet stack. Therefore, the receiving positions serve also as supporting positions. Specifically, when the joggers 51 and 52 are positioned at the receiving positions (supporting positions), the sheet aligning surfaces 51*b* and 52*b* (see FIG. 3) as aligning portions do not contact the lateral ends of each sheet S conveyed, while the sheet supporting surfaces 51*a* and 52*a* (see FIG. 3) as supporting portions support the sheet S.

Since the sheet S is conveyed on a center reference basis, each of the joggers 51 and 52 moves more laterally inwardly than the passage positions (see FIG. 4A). In the present exemplary embodiment, the jogger 51 (reference side jogger) is positioned at the reference position for aligning the sheet aligning surface 51*b* (FIG. 3) with the second alignment reference wall 53, and the jogger 51 does not move any more laterally inwardly than the reference position.

When the sheet S has been conveyed to the intermediate stacking portion 34, the lower side of the sheet S is supported by the pair of joggers 51 and 52 that has been moved to the receiving positions. Then, the sheet aligning surfaces 51*b* and 52*b* (FIG. 3) move to provide an area wider than the conveyance area of the sheet S by a predetermined lateral width so that the joggers do not deter the conveyance of the sheet S.

Then, as illustrated in FIG. 4C, the jogger 52 moves laterally inwardly as illustrated by the arrow of FIG. 4C to move the supported sheet S in the direction of the arrow, thus pushing one lateral end of the sheet S against the sheet aligning surface 51*b* (FIG. 3) of the jogger 51 and to the second alignment reference wall 53. Meanwhile, the jogger 52 moves to a pressing position according to the length of the sheet S in the width direction and then stops at that position.

Thus, the pair of joggers 51 and 52 has moved to the alignment positions for supporting and aligning the lateral ends of the sheet stack. As a result, the pair of joggers 51 and 52 sandwiches the sheet stack to align the lateral ends of the sheet stack. At the alignment positions, the sheet supporting surfaces 51*a* and 52*a* as supporting portions support the lateral ends of the sheet stack, and the sheet aligning surfaces 51*b* and 52*b* as aligning portions push and align the lateral ends. This alignment process is performed for each sheet conveyed by the joggers 51 and 52.

The alignment position of the jogger 51 (reference side jogger) is identical to its receiving position (supporting position). Specifically, the sheet S is aligned with reference to its one lateral end (hereinafter referred to as side alignment), not on a center reference basis, to be ready for stapling process. In this state, stapling process is performed by the stapler 54.

In the stapling process mode, regardless of the sheet size, one lateral end of the sheet stack is aligned on a side alignment basis with reference to the second alignment reference wall 53, and then stapling process is performed by the stapler 54.

Then, as illustrated in FIG. 4D, the joggers 51 and 52 move in respective directions illustrated by the arrows away from each other, i.e., more outwardly in the width direction than the alignment positions and receiving positions (supporting positions) and move to the retracting positions for dropping a sheet bundle onto the first stacking tray 35. In this state, since the sheet stack is aligned on a side alignment basis, not on a center reference basis, the sheet bundle bound by stapling process falls onto the first stacking tray 35 from the joggers 51 and 52 disposed thereabove.

Specifically, when a job in the stapling process mode and a job in the stack mode are performed in succession, a sheet and a sheet bundle discharged by respective jobs will be stacked on the first stacking tray 35, mutually laterally offset for each job.

The passage positions for the pair of joggers 51 and 52 in the stack mode differ according to each individual sheet size, that is, length of sheets in the width direction. On the other hand, the retracting positions of the joggers 51 and 52 in the stapling process mode remain unchanged regardless of the size of sheet bundles. Further, the retracting positions are set at such positions where a sheet bundle having the maximum length in the width direction to be used falls (hereinafter referred to as maximum separation positions) so that sheet bundles of any size can fall.

Figure 5:
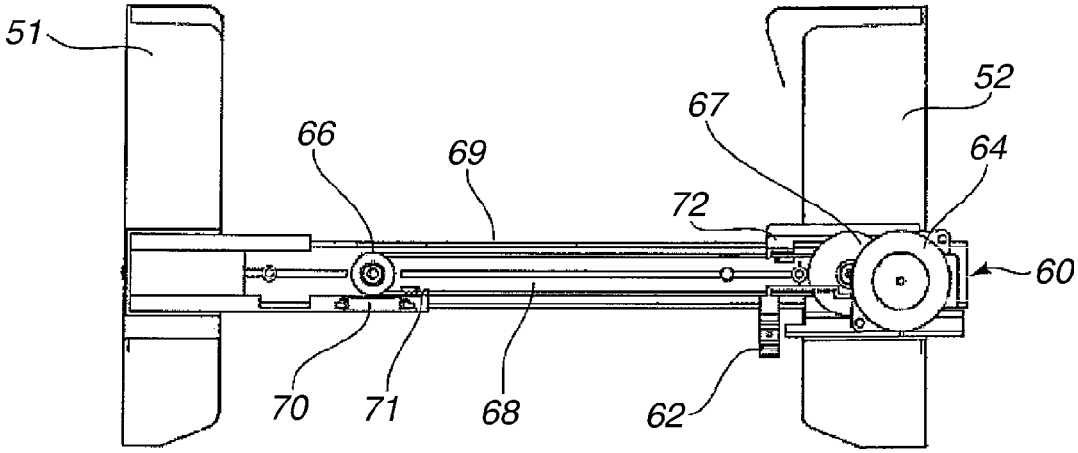
FIG. 5 illustrates the joggers and a drive unit for driving the joggers.

A drive unit for driving the joggers 51 and 52 will be described in detail below. FIG. 5 illustrates the joggers 51 and 52, and a drive unit 60 for driving the joggers 51 and 52.

As illustrated in FIG. 5, the pair of joggers 51 and 52 is driven by one drive unit 60. The drive unit 60 includes a jogger motor 64, pulleys 66 and 67 driven by the jogger motor 64, and a timing belt 68.

The timing belt 68 is provided with sliders 71 and 72 fixed thereto. The jogger 52 is fixed to the slider 72 and the jogger 51 is connected to the slider 71 via a spring 70. The joggers 51 and 52 are laterally movable by the lateral movement of the sliders 71 and 72 guided by a guide 69. The position of the jogger 52 is detected by a jogger position sensor 62.

In the stapling process mode, within a range from the retracting positions to the receiving positions, the pair of joggers 51 and 52 synchronously moves closer to each other in association with the movement of the timing belt 68.

On the other hand, when the jogger 51 (reference side jogger) reaches a position, which is almost the same lateral position as the second alignment reference wall 53, it is stopped at the reference position by a stopper (not illustrated). Then, when the spring 70 is extended, only the jogger 52 moves laterally inwardly until it reaches the alignment position. That is, the alignment position of the jogger 51 is identical to its receiving position (supporting position).

On the other hand, in the stack mode, the pair of joggers 51 and 52 laterally moves away from or closer to each other according to the sheet size (length of sheet in the width direction) to the passage positions. In this case, the joggers 51 and 52 move within a range between the retracting and receiving positions.

Figure 6:
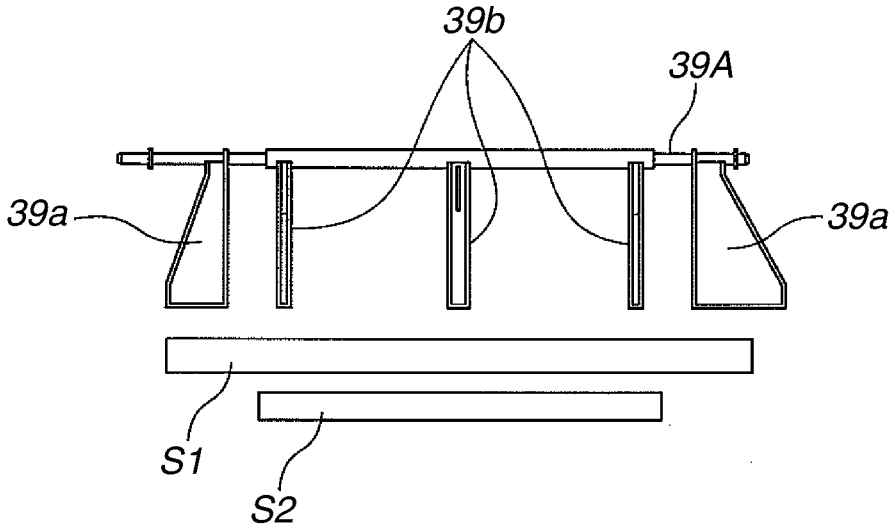
FIG. 6 illustrates full-state detection sensor levers.

The full-state detection sensor levers 39 will be described in detail below. FIG. 6 illustrates the full-state detection sensor levers 39. As described above, the present exemplary embodiment is provided with five full-state detection sensor levers 39.

The five full-state detection sensor levers 39 include two full-state detection sensor levers 39*a* for detecting the full state of large-size sheets S1 such as LTR, LGL, and A4, and three full-state detection sensor levers 39*b* for detecting the full state of small-size sheets S2 such as A5, among sheets conveyed to the sheet processing apparatus 1. The full-state detection sensor levers 39*a* are disposed more laterally outwardly than the full-state detection sensor levers 39*b*.

The full-state detection sensor levers 39*a* and 39*b* are supported by a common rotatable shaft 39A in such a manner that they are independently rotatable of each other. Predetermined rotational positions of the full-state detection sensor levers 39 are detected by respective photo sensors. To improve the detection accuracy even for a sheet having a curled end, the full-state detection sensor levers 39*a* and 39*b* are disposed so as to detect the vicinity of the lateral ends of the sheet.

Specifically, the full-state detection sensor levers 39*a* are disposed facing each other in the vicinity of the lateral ends of a large-size sheet S1. The full-state detection sensor levers 39*b* are disposed facing each other in the vicinity of the lateral ends of a small-size sheet S2.

When the upper discharge rollers 32 are elevated and moved to a separation position, the roller shaft of the upper discharge rollers 32 contacts the full-state detection sensor levers 39 to raise them. Thus, the full-state detection sensor levers 39 move from a detecting position for detecting the full state of the sheets to a retracting position (the position illustrated by a dashed line in FIG. 2) for reteacting upward.

Figure 7:
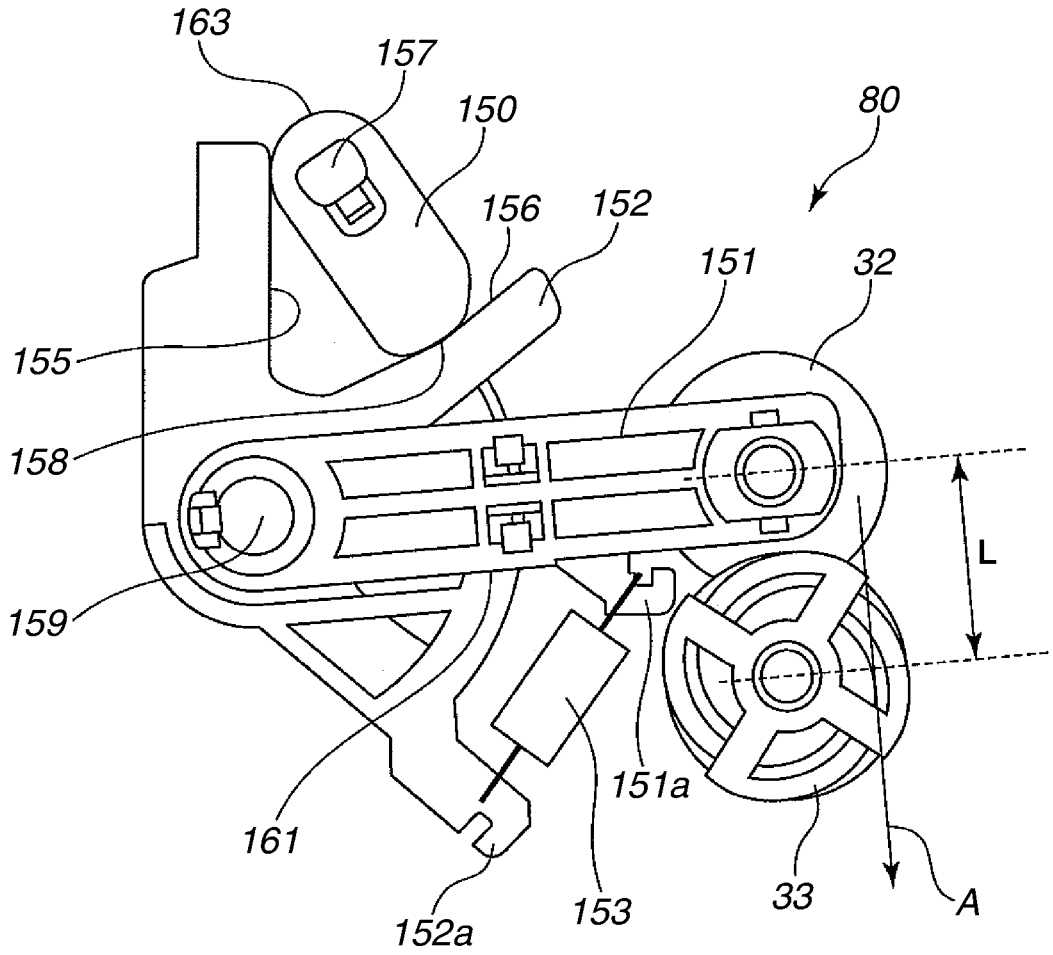
FIG. 7 illustrates a contacting/separating mechanism of upper discharge rollers when the vicinity of pairs of discharge rollers illustrated in FIG. 2 is viewed from the posterior side.

The contacting/separating mechanism for separate the pairs of discharge rollers 32 and 33 from each other will be described in detail below. FIG. 7 illustrates a contacting/separating mechanism 80 of the upper discharge rollers 32 when the vicinity of the pairs of discharge rollers 32 and 33 illustrated in FIG. 2 is viewed from the posterior side.

The contacting/separating mechanism 80 moves the upper discharge rollers 32 to the contact position at which the upper discharge rollers 32 contact the lower discharge rollers 33 or to the separation position at which the upper discharge rollers 32 separate from the lower discharge rollers 33. FIG. 7 illustrates a state where the upper discharge rollers 32 have moved to the contact position.

The contacting/separating mechanism 80 includes a fulcrum (pivoting point) shaft 157 rotatably driven by a separation motor 65 (FIG. 11), and a rotating cam 150 attached to the fulcrum shaft 157. Further, the contacting/separating mechanism 80 includes a spring arm 152 rotated centering on the fulcrum shaft 159 by the rotating cam 150.

Cam contact surfaces 155 and 156 having a shape of approximate V letter are formed at a point of the spring arm 152 where force is applied. The cam contact surfaces 155 and 156 contact cam surfaces 158 and 163 of the rotating cam 150. Then, the spring arm 152 rotates to a position corresponding to the rotational position of the rotating cam 150, with the rotation of the spring arm 152 being regulated by the rotating cam 150.

Further, the contacting/separating mechanism 80 includes an arm 151 rotatably supported by the fulcrum shaft 159 to support an end of the roller shaft of the upper discharge rollers 32 and perform contacting/separating operation of the upper discharge rollers 32. A hook 151*a* is formed at a lower end in the vicinity of the center of the arm 151. A hook 152*a* is formed at an end of the spring arm 152, which serves as a point of application. A tension spring 153 is hooked to the hooks 151*a* and 152*a*.

Because of the weights of the arm 151 and the upper discharge rollers 32, and biasing force of the tension spring 153, force is applied to the upper discharge rollers 32 in the direction of an arrow A (toward the side of the lower discharge rollers 33) centering on the fulcrum shaft 159. Further, a stopper 161 is formed on the spring arm 152. When the arm 151 is biased in the direction of the arrow A, it contacts the stopper 161. This configuration enables the spring arm 152, the tension spring 153, and the arm 151 to rotate together.

Referring to FIG. 7, the cam surface 163 of the rotating cam 150 contacts the cam contact surface 155 of the spring arm 152 to fix the spring arm 152 so that it may not rotate. Then, the upper discharge rollers 32 are retained at the contact position.

Even if external force is applied to the upper discharge rollers 32, the tension spring 153 can generate a predetermined conveyance pressure necessary to convey a sheet between the pairs of discharge rollers 32 and 33, and thus the distance L between the pair of discharge rollers 32 and 33 can be maintained constant.

Figures 8A, 8B, 8C, 8D, 8E, 8F, 8G, 8H, 8I, 8J, 8K, 8L, 8M, 8N, 8O:
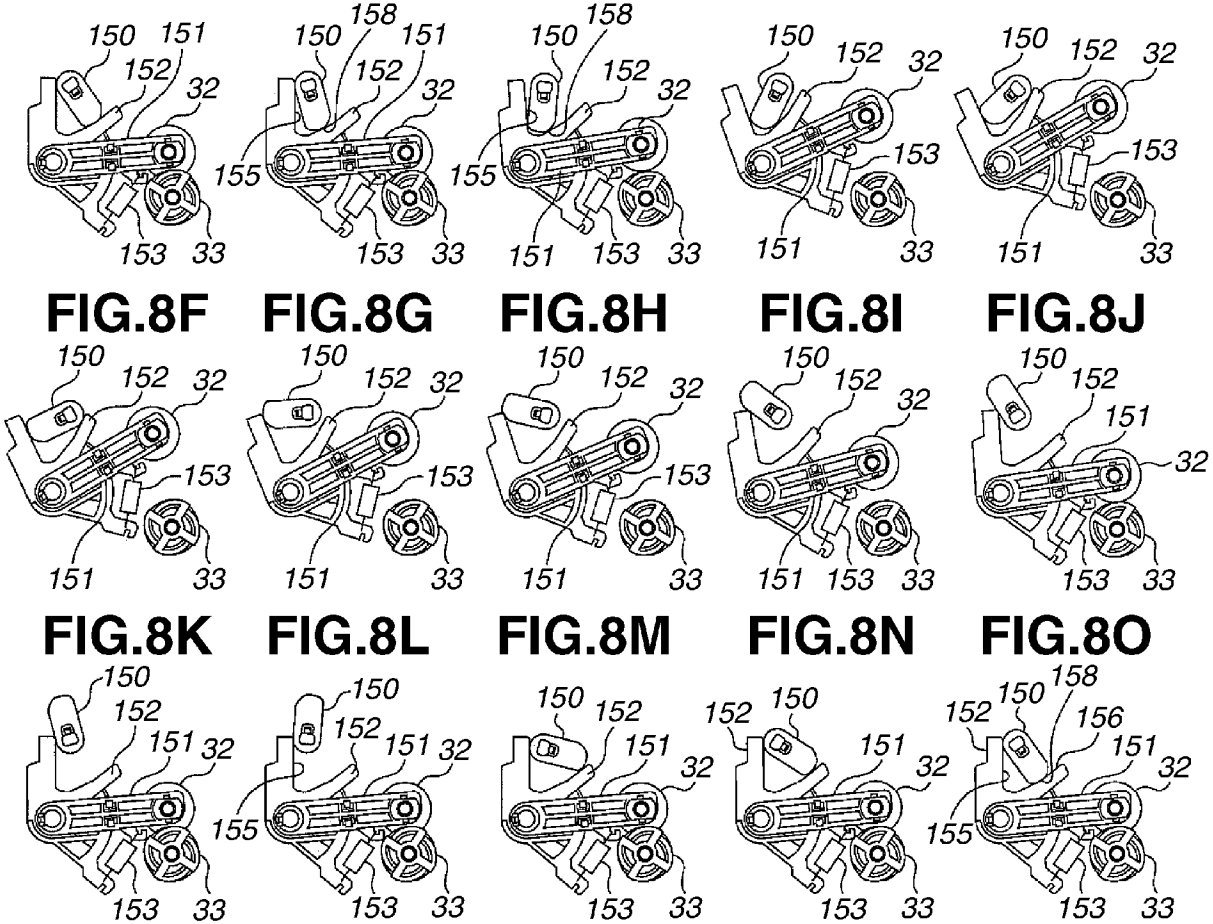
FIGS. 8A to 8O illustrate positions of the upper discharge rollers when a rotating cam of the contacting/separating mechanism is rotated.

FIGS. 8A to 8O illustrate positions of the upper discharge rollers 32 when the rotating cam 150 of the contacting/separating mechanism 80 is rotated. Referring to FIGS. 8A to 8O, the rotational position of the rotating cam 150 is changed clockwise at 20-degree intervals.

Between states of FIGS. 8L and 8M, the rotation of the rotating cam 150 causes no change in rotational angle of the arm 151, and therefore the rotating cam 150 is rotated 100 degrees at one time.

Figure 9:
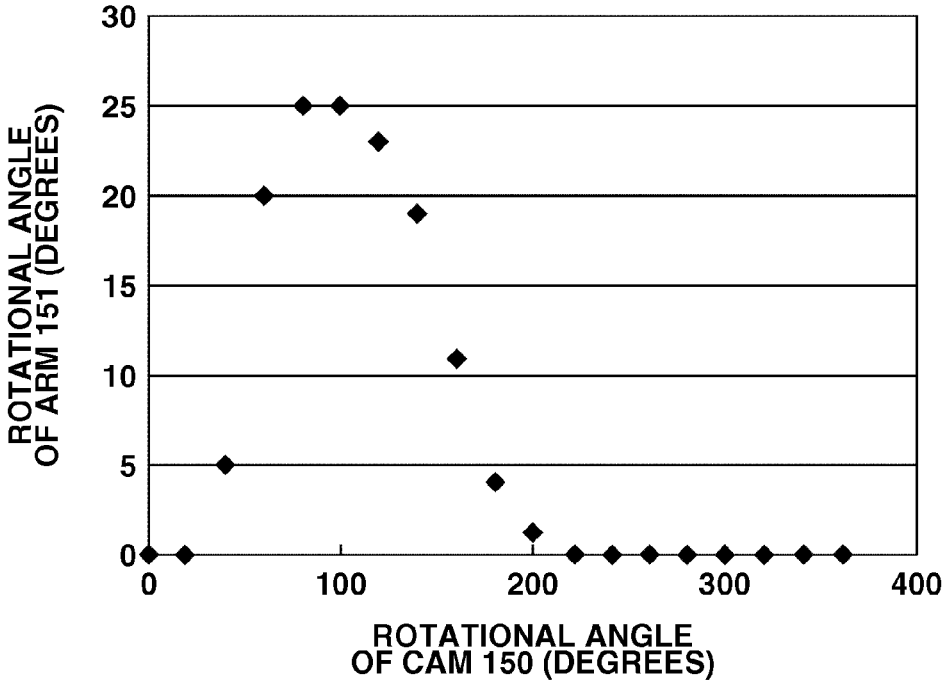
FIG. 9 is a graph illustrating a relation between the rotational angle of the rotating cam and the rotational angle of an arm supporting the upper discharge rollers.

FIG. 9 is a graph illustrating a relation between the rotational angle of the rotating cam 150 and the rotational angle of the arm 151 supporting the upper discharge rollers 32. FIGS. 8A to 8O will be described below with reference to the graph in FIG. 9.

Similar to FIG. 7, FIG. 8A illustrates a state where the upper discharge rollers 32 have moved to the contact position. The rotational angle of the rotating cam 150 in this state is referred to as a reference position (0 degrees). Further, the rotational angle of the arm 151 in this state is also referred to as a reference position (0 degrees).

FIG. 8B illustrates a state where the rotating cam 150 is rotated 20 degrees from the reference position. Since the cam surface 158 of the rotating cam 150 has not yet contacted the cam contact surface 155, the rotational angle of the arm 151 remains 0 degrees. Then, as the rotating cam 150 is further rotated, the upper discharge rollers 32 start separating from the lower discharge rollers 33.

FIG. 8C illustrates a state where the rotating cam 150 is rotated 40 degrees from the reference position, and the cam surface 158 of the rotating cam 150 starts contacting the cam contact surface 155. Accordingly, the spring arm 152 is rotated in a direction opposite to the direction of the arrow A in FIG. 7 against the weight of the upper discharge rollers 32. Thus, the stopper 161 formed on the spring arm 152 starts raising the arm 151 in a direction opposite to the direction of the arrow A.

As illustrated in FIGS. 8D and 8E, both the spring arm 152 and the arm 151 are rotated together in association with the rotation of the rotating cam 150 to upwardly separate the upper discharge rollers 32 from the lower discharge rollers 33. Subsequently, as illustrated in FIG. 8F, when the rotating cam 150 is rotated 100 degrees from the reference position, the upper discharge rollers 32 have been moved to the separation position (highest point). In this state, the rotational angle of the arm 151 is 25 degrees.

When the rotating cam 150 is further rotated from the state of FIG. 8F, as illustrated in FIGS. 8G to 8K, the spring arm 152 contacts the rotating cam 150 and the upper discharge rollers 32 are lowered by their own weights in a regulated way. In the state of FIG. 8L, the upper discharge rollers 32 reach a lowest point and the rotational angle of the arm 151 returns to 0 degrees.

In this state, however, since the rotating cam 150 contacts the cam contact surface 155, the rotation of the spring arm 152 in the direction of the arrow A in FIG. 7 (downward direction) is regulated but the rotation in the opposite direction (upward direction) is not. In other words, the upper discharge rollers 32 will be moved in the direction of separation by slight force. In this state, therefore, the predetermined conveyance pressure necessary to convey a sheet is not applied between the discharge rollers 32 and 33.

Subsequently, the rotating cam 150 is rotated in order of states of FIGS. 8M and 8N. Finally, as illustrated in FIG. 80, when the rotating cam 150 has been rotated 360 degrees from the reference position, the upper discharge rollers 32 reach the contact position. In this state, since the cam surface 158 of the rotating cam 150 contacts the cam contact surface 156, and the cam surface 163 contacts the cam contact surface 155, the rotation of the spring arm 152 is regulated by the rotating cam 150.

Since force is applied to the arm 151 in the direction of the arrow A in FIG. 7 by its own weight as well as the biasing force of the tension spring 153, the predetermined conveyance pressure is applied between the discharge rollers 32 and 33.

Figure 10:
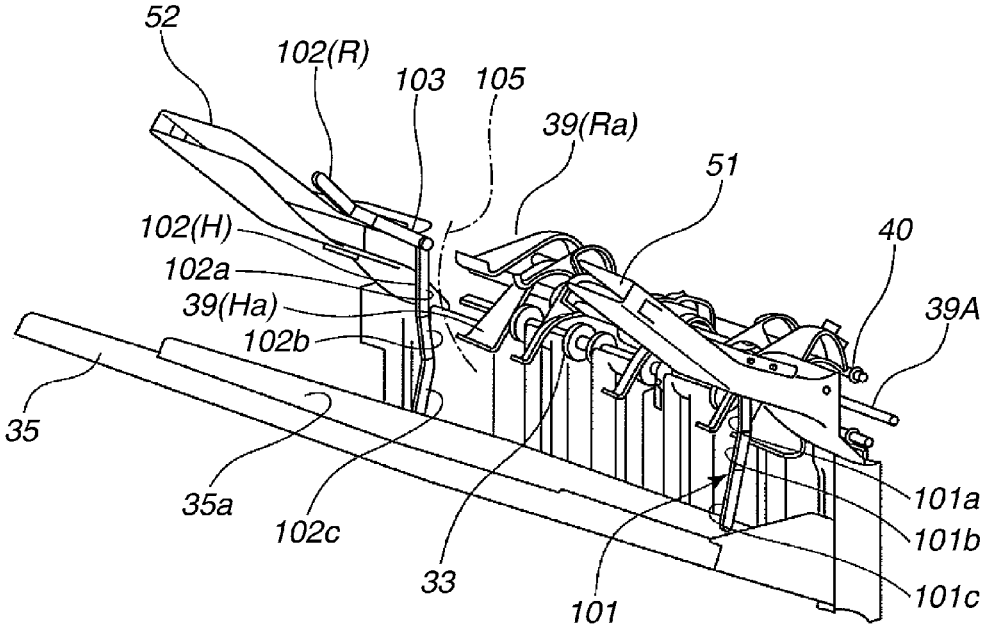
FIG. 10 is a perspective view illustrating the essential part of the sheet processing apparatus having regulating members.

In the present exemplary embodiment, the sheet processing apparatus 1 is provided with a pair of regulating members 101 and 102 for regulating the lateral ends of a sheet falling onto the first stacking tray 35, as illustrated in FIG. 10. In FIGS. 1 to 4 that illustrate the overall configuration, the regulating members 101 and 102 are not illustrated.

As illustrated in FIG. 10, one regulating member 101 is disposed at the jogger 51 and the other regulating member 102 is disposed at the jogger 52. Thus, the jogger 51 and the regulating member 101 are laterally movable together, and the jogger 52 and the regulating member 102 are laterally movable together.

The regulating members 101 and 102 are bar-shaped members. Base end portions of the regulating members 101 and 102 are rotatably supported by the pair of joggers 51 and 52, respectively, and leading end portions of the regulating members 101 and 102 are vertically suspended toward the first stacking tray 35.

The following describes a configuration according to the present exemplary embodiment with which regulating members are provided at the pair of joggers 51 and 52, which are integrally formed of the sheet supporting surfaces 51*a* and 52*a* as supporting portions and the sheet aligning surfaces 51*b* and 52*b* as aligning portions, respectively. However, the present invention is also effective for a configuration with which regulating members are provided, separately from the aligning members, at a pair of supporting members movable between the supporting positions for supporting a conveyed sheet and the passage positions for enabling passage of the sheet.

When the regulating members 101 and 102 are positioned at the regulating positions H, they are vertically suspended toward the first stacking tray 35. The regulating members 101 and 102 are disposed more laterally inwardly than the joggers 51 and 52, respectively, to regulate the lateral ends of a sheet passing through between the joggers 51 and 52 and guide it to the first stacking tray 35.

Further, since the regulating members 101 and 102 are movable together with the joggers 51 and 52, respectively, they are driven by the drive unit 60 (FIG. 5) that drives the joggers 51 and 52. Specifically, the drive unit 60 serves not only as a drive source for laterally moving the joggers 51 and 52 but also as a drive source for laterally moving the regulating members 101 and 102. Therefore, it is not necessary to provide separate drive sources, enabling the miniaturization of the apparatus and cost reduction.

In the stapling process mode, since a sheet bundle bound by stapling process is dropped and stacked on the first stacking tray 35, the sheet bundle is not likely to become disordered. In the stack mode, on the other hand, since light sheets are stacked on the first stacking tray 35 one by one, the stacked sheets are likely to become disordered by the air resistance.

Therefore, in the present exemplary embodiment, when the sheet processing apparatus 1 is set in the stack mode, the joggers 51 and 52 are moved to respective lateral passage positions according to the length of the sheet in the width direction to move the regulating members 101 and 102 to the regulating positions for regulating the lateral ends of the sheet.

Specifically, sheets of various sizes such as A5 sheets and LTR sheets are stacked on the first stacking tray 35. In the stack mode, sheets are stacked on the first stacking tray 35 on a center reference basis.

The pair of joggers 51 and 52 moves closer to or away from each other with reference to the lateral center of the sheet by an equal amount by the jogger motor 64 (FIG. 5) of the drive unit 60. Accordingly, the pair of regulating members 101 and 102 moves closer to or away from each other with reference to the lateral center of the sheet by an equal amount by the jogger motor 64 of the drive unit 60.

Then, the pair of regulating members 101 and 102 is moved in advance so as to guide the lateral ends of a sheet stacked on the first stacking tray 35 among sheets of various sizes such as A5 sheets and LTR sheets. By moving in advance in this way the pair of regulating members 101 and 102 to the regulating positions for regulating the lateral ends of the sheet before the sheet is stacked on the first stacking tray 35, the sheet alignment performance for sheets of various sizes can be improved.

Further, when stacking sheets of various sizes together on the first stacking tray 35, the pair of regulating members 101 and 102 moves together with the pair of joggers 51 and 52 to enable easily regulating the lateral ends of sheets of various sizes. Thus, the sheet alignment performance for sheets of various sizes can be improved.

The regulating members 101 and 102 are vertically suspended toward the first stacking tray 35. At this timing, when the size of sheets already stacked on the first stacking tray 35 is larger than the size of a discharged sheet, the leading ends of the regulating members 101 and 102 contact the upper surface of the sheets already stacked on the first stacking tray 35 and then the regulating members 101 and 102 stop.

On the other hand, when the size of sheets already stacked on the first stacking tray 35 is smaller than the size of a discharged sheet, the leading ends of the regulating members 101 and 102 move to stopping positions below the upper surface of the sheets already stacked on the first stacking tray 35 and then the regulating members 101 and 102 stop.

The regulating members 101 and 102 are formed in mirror-image symmetry. The regulating member 101 has three surfaces 101*a*, 101*b*, and 101*c*, and the regulating member 102 has three surfaces 102*a*, 102*b*, and 102*c*, respective three surfaces facing each other.

Specifically, each of the surfaces 101*a* and 102*a* is an approximately vertical surface disposed more outwardly in the width direction than the sheet width by a predetermined amount to provide a predetermined skew margin from a lateral end of the conveyed sheet. Each of the surfaces 101*b* and 102*b* is an inclined surface extending from the lower leading end of each of the surfaces 101*a* and 102*a*, respectively, toward the first stacking tray 35 while being inclined laterally inwardly.

Each of the surfaces 101*c* and 102*c* is a contact surface vertically extending from the lower leading end of each of the inclined surfaces 101*b* and 102*b*, respectively, toward the first stacking tray 35 to contact a lateral end of the sheet. In other words, each of the surfaces 101*a* and 102*a* is disposed more outwardly in the width direction than each of the contact surfaces 101*c* and 102*c*, respectively, by a predetermined amount. The regulating positions (for regulating the lateral ends of the sheet) of the regulating members 101 and 102 refer to positions at which the gap between the contact surfaces 101*c* and 102*c* of the regulating members 101 and 102 coincides with the sheet width.

Thus, a sheet discharged onto the first stacking tray 35 is reliably guided downward, preventing the lateral ends from being caught by the surfaces 101*a* and 102*a* even in the case of discharge with skew. Then, the sheet falling along the surfaces 101*a* and 102*a* is then guided along the inclined surfaces 101*b* and 102*b* toward the contact surfaces 101*c* and 102*c* below, respectively.

Subsequently, the lateral ends of the sheet falling along the contact surfaces 101*c* and 102*c* are regulated by the contact surfaces 101*c* and 102*c*, respectively, and accordingly the sheet can be correctly stacked on a predetermined lateral position on the first stacking tray 35. Thus, the sheet lateral alignment performance of the sheets stacked on the first stacking tray 35 can be stably maintained.

Although sheets can be regulated by the pair of regulating members 101 and 102 vertically suspended toward the first stacking tray 35, other processing may be deterred by the thus-formed regulating members 101 and 102. For example, the pair of regulating members 101 and 102 may deter an operation for putting a sheet stack onto the joggers 51 and 52 in the stapling process mode, or an operation for laterally moving the joggers 51 and 52 closer to each other in the stack mode.

To solve this problem, as illustrated in FIG. 10, the regulating members 101 and 102 are rotatably supported at the upper part of the guide surfaces 51*c* and 52*c* disposed above the sheet supporting surfaces 51*a* and 52*a*, upstream in the sheet conveyance direction of the joggers 51 and 52, respectively. Specifically, a rotational fulcrum 103 is disposed above a sheet conveyed to the joggers 51 and 52.

The regulating member 102 is rotated centering on the rotational fulcrum 103 and movable to the regulating position H for regulating the lateral ends of the sheet and to the retracting position R for retracting upward from the regulating position H. Similarly, although not illustrated, the regulating member 101 is rotated in association with the jogger 51 to be movable to the regulating position and to the retracting position.

Figure 17A:
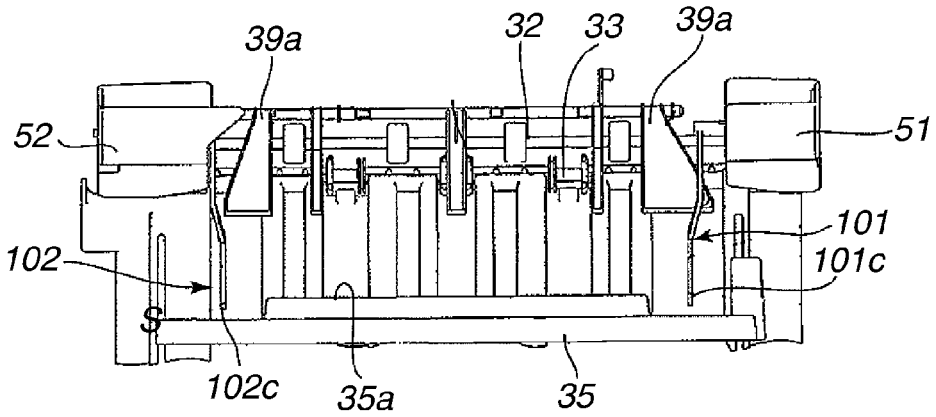
FIGS. 17A to 17C illustrate operations of a pair of regulating members when the sheet processing apparatus is set in the stack mode in which LTR sheets are stacked.
Figure 17B:
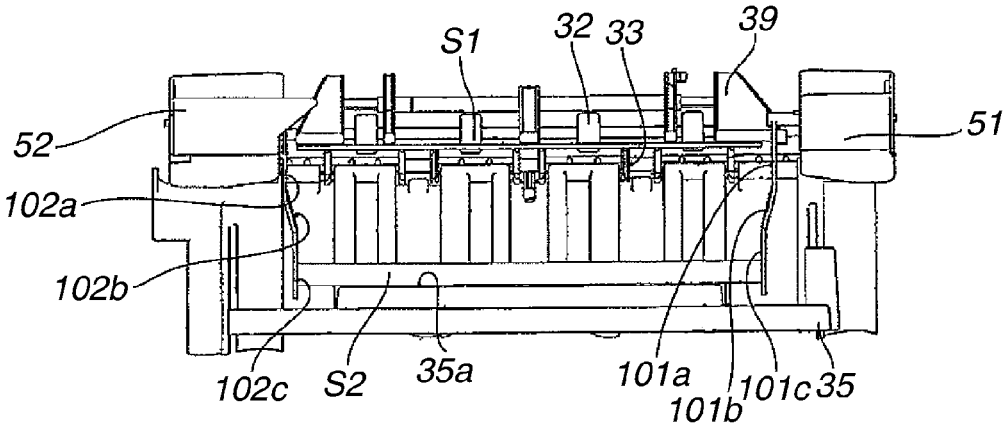

The first stacking tray 35 is provided with a sheet stacking surface 35*a*, as illustrated in FIG. 10, FIG. 17A and FIG. 17B, having a length in the width direction smaller than the minimum length in the width direction of the sheet to be used. When no sheet is stacked on the sheet stacking surface 35*a* of the first stacking tray 35 when the pair of regulating members 101 and 102 has moved to the regulating positions H, the lower leading ends of the regulating members 101 and 102 are vertically suspended below the sheet stacking surface 35*a*. This enables reliably laterally regulating even a sheet to be stacked first, thus improving the sheet alignment performance.

The first stacking tray 35 is vertically movable in such a manner that it is positioned at a highest level when no sheet is stacked thereon, and lowered with increasing number of sheets stacked thereon. Therefore, the length of the pair of regulating members 101 and 102 is adjusted to the position of the highest level of the first stacking tray 35, accommodating the variation in the number of sheets stacked thereon.

Further, when the pair of regulating members 101 and 102 has moved to the retracting positions R, the pair of regulating members 101 and 102 is retracted above the sheet supporting surfaces 51*a* and 52*a* of the joggers 51 and 52, respectively. The full-state detection sensor levers 39 are also rotated centering on the rotatable shaft 39A and moved to a detecting position Ha and to a retracting position Ra.

When the full-state detection sensor levers 39*a* are positioned at the retracting position Ra, they are stored between the sheet supporting surfaces 51*a* and 52*a* and the guide surfaces 51*c* and 52*c* of the joggers 51 and 52, respectively, when the joggers 51 and 52 have moved inwardly in the width direction to the positions of the full-state detection sensor levers 39*a*.

At this timing, as the upper discharge rollers 32 move to the separation position, the plurality of full-state detection sensor levers 39 is raised and moved to the retracting position Ra by the roller shaft of the upper discharge rollers 32. As the upper discharge rollers 32 move to the contact position, the full-state detection sensor levers 39 moves to the detecting position Ha by their own weights. Specifically, the full-state detection sensor levers 39 are driven by the separation motor 65 for separating the upper discharge rollers 32 from the lower discharge rollers 33, and moved to the detecting position Ha and to the retracting position Ra.

A rotating locus 105 of the leading end portions of the full-state detection sensor levers 39 does not overlap with the regulating members 101 and 102. Further, the regulating members 101 and 102 and the full-state detection sensor levers 39 move to their respective retracting positions R and Ra in association with the separation operation of the upper discharge rollers 32. In other words, the sheet processing apparatus 1 includes a movement mechanism 90 (FIG. 11) driven by the separation motor 65 to move the pair of regulating members 101 and 102 from the regulating positions H to the retracting positions R in association with the separation operation of the discharge rollers 32 and 33.

Figure 11:
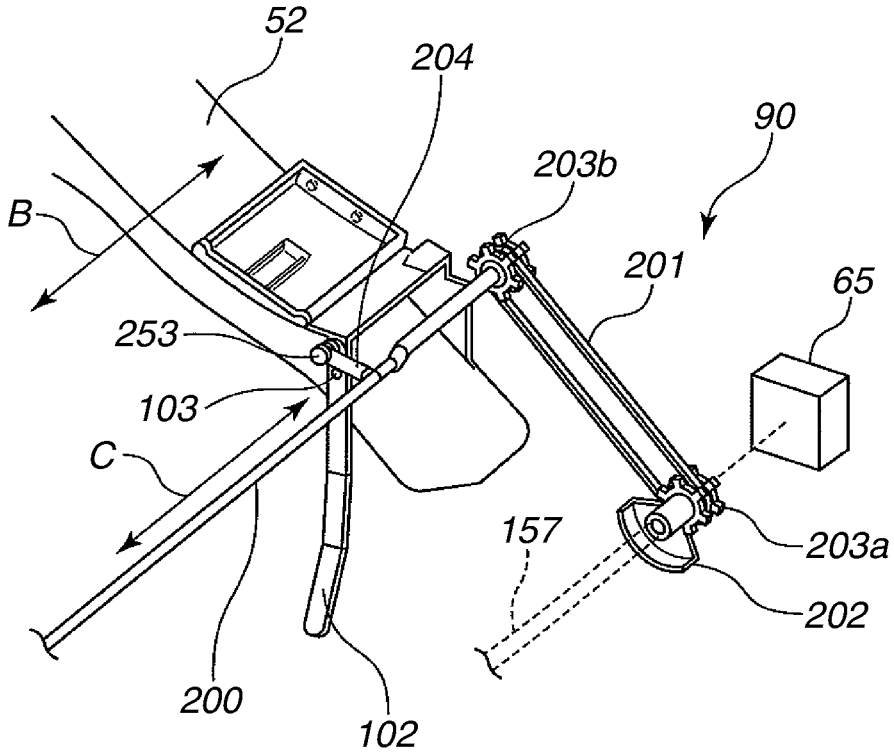
FIG. 11 is a perspective view illustrating a movement mechanism.

FIG. 11 illustrates the configuration of the regulating member 102 in the movement mechanism 90. The configuration of the regulating member 101 is partially omitted since it is similar to the configuration of the regulating member 102.

The regulating members 101 and 102 are rotated by the movement mechanism 90 driven by the separation motor 65. The separation motor 65 rotates the fulcrum shaft 157 connected to the rotating cam 150 of the contacting/separating mechanism 80 of the upper discharge rollers 32 in FIG. 7.

As illustrated in FIG. 11, the movement mechanism 90 includes a pair of pulleys 203*a* and 203*b*, and a timing belt 201 stretched around the pair of pulleys 203*a* and 203*b*. The pulley 203*a* is fixed to the fulcrum shaft 157 and rotated by the drive of the separation motor 65. The pulley 203*b* is fixed to a crankshaft 200 rotatably fixed to a frame (not illustrated) of the sheet processing apparatus main body 1A in FIG. 1.

Further, the crankshaft 200 and the regulating member 102 are connected with each other by a tension spring 204. Similarly, the crankshaft 200 and the regulating member 101 are connected with each other by another tension spring (not illustrated). Specifically, the movement mechanism 90 including the pair of pulleys 203*a* and 203*b*, the timing belt 201, the crankshaft 200, the tension spring 204, and another tension spring (not illustrated) moves the pair of regulating members 101 and 102 to the regulating positions H and to the retracting positions R (FIG. 10).

Specifically, as illustrated in FIG. 11, the regulating member 102 has the rotational fulcrum 103 in the vicinity of the base end portion between the leading end portion and the base end portion. One end portion of the tension spring 204 is hooked to a hook 253 disposed at the base end portion of the regulating member 102, and the other end portion of the tension spring 204 is axially (laterally) movably hooked to the crankshaft 200.

Similarly, one end portion of another tension sprint (not illustrated) is hooked to a hook disposed at the base end portion of the regulating member 101, and the other end portion of the tension spring is axially (laterally) movably hooked to the crankshaft 200. When the crankshaft 200 rotates to pull the tension spring 204, the regulating member 102 is pulled by the tension spring 204 to move from the regulating position H to the retracting position R illustrated in FIG. 10.

The fulcrum shaft 157 and the crankshaft 200 are connected with each other with a speed reduction ratio of 1:1 via the pair of pulleys 203*a* and 203*b* and the timing belt 201. In other words, when the fulcrum shaft 157 rotates once, the crankshaft 200 also rotates once.

The pulley 203*a* is provided with a separation sensor lever 202 fixed thereto to detect one rotation of the fulcrum shaft 157 through positional detection by using a photo sensor (not illustrated), thus controlling the contacting/separating operation of the upper discharge rollers 32. When the jogger 52 laterally moves in the direction of an arrow B, the regulating member 102 also moves together. Accordingly, the tension spring 204 also laterally moves together in the direction of an arrow C along the crankshaft 200.

Figure 12A:
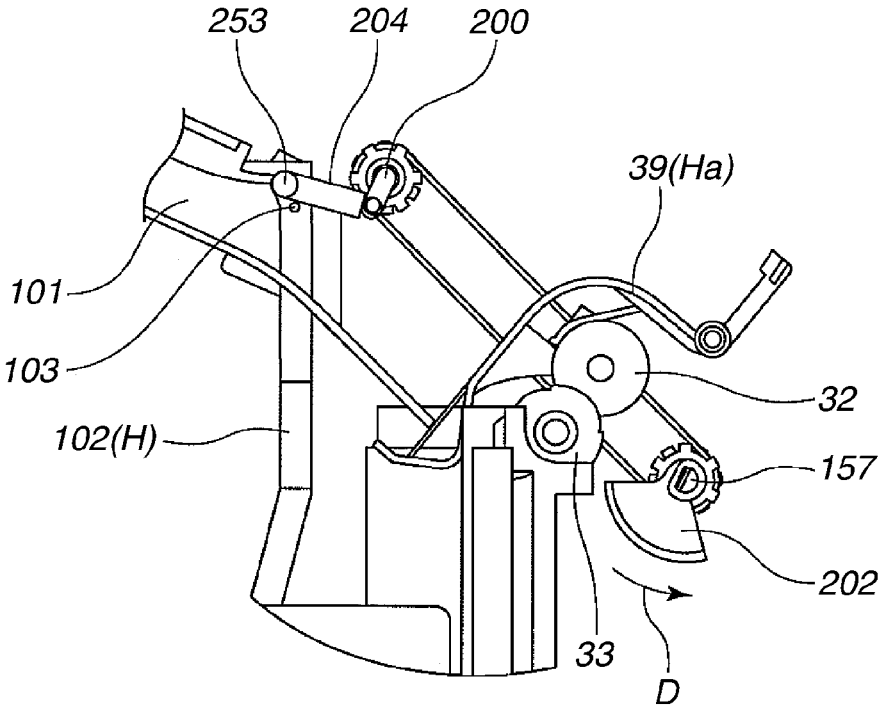
FIGS. 12A and 12B illustrate positions of the regulating members with respect to the position of the upper discharge rollers.
Figure 12B:
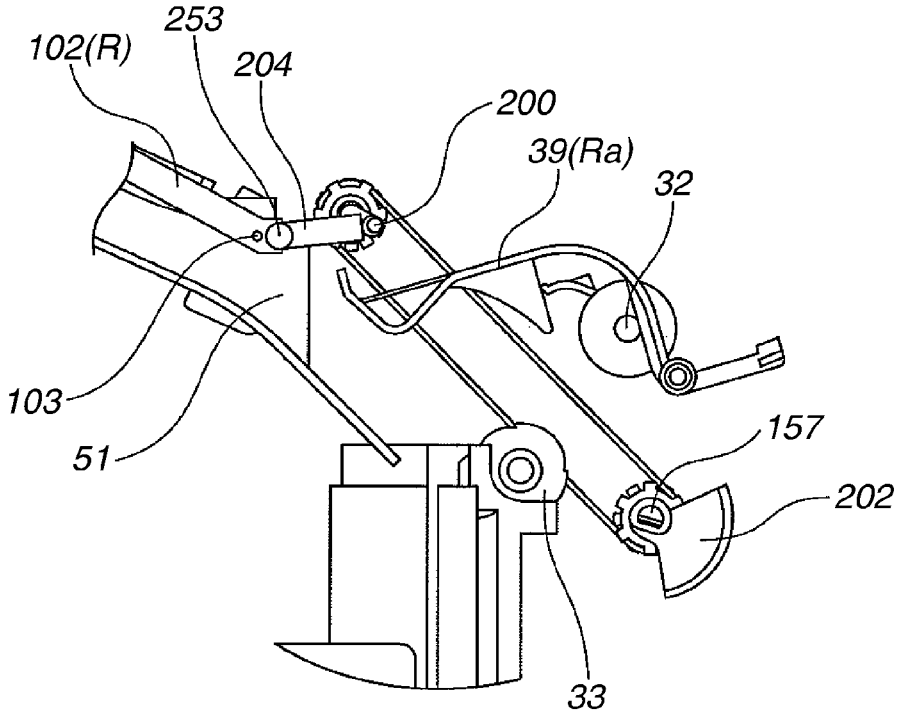

FIGS. 12A and 12B illustrate positions of the regulating member 102 with respect to the positions of the upper discharge rollers 32. FIG. 12A illustrates a state where the regulating member 102 has moved to the regulating position H after the upper discharge rollers 32 are moved to the contact position. FIG. 12B illustrates a state where the regulating member 102 has moved to the retracting position R after the upper discharge rollers 32 are moved to the separation position.

As illustrated in FIG. 12A, when the upper discharge rollers 32 have moved to the contact position, the crankshaft 200 is close to the hook 253 of the regulating member 102, and the tension spring 204 is at its natural length. Since the tension spring 204 is at its natural length and generates no tensional force, the regulating member 102 is positioned at the regulating position H for regulating a lateral end of the sheet by vertically being suspended toward the first stacking tray 35 by its own weight.

Therefore, even if the regulating member 102 is rotated in the sheet conveyance direction, the tension spring 204 generates no tensional force and therefore the regulating member 102 is rotatable centering on the rotational fulcrum 103. Since the upper discharge rollers 32 are positioned at the contact position, the full-state detection sensor lever 39 is positioned at the detecting position Ha.

When the fulcrum shaft 157 is rotated 100 degrees in the direction of an arrow D illustrated in FIG. 12A, the upper discharge rollers 32 move to the separation position as illustrated in FIG. 12B. At the same time, the crankshaft 200 is driven and rotated 100 degrees via the pair of pulleys 203*a* and 203*b* and the timing belt 201, since the fulcrum shaft 157 and the crankshaft 200 are connected to each other with a speed reduction ratio of 1:1 via the pair of pulleys 203*a* and 203*b* and the timing belt 201.

When the crankshaft 200 is rotated in this way, the crankshaft 200 is positioned away from the hook 253 of the regulating member 102, and the tension spring 204 is pulled by the crankshaft 200, as illustrated in FIG. 12B. Thus, the regulation the hook 253 of the regulating member 102 is pulled by the tension spring 204, and the regulating member 102 is rotated centering on the rotational fulcrum 103 by tensional force of the tension spring 204 and moved to the retracting position R.

As illustrated in FIG. 12B, the regulating members 101 and 102 having moved to the retracting positions R are aligned with the height of the upper guides (the guide surfaces 51*c* and 52*c* in FIG. 3) of the joggers 51 and 52, respectively, having a cross-sectional shape of lying squarish letter U.

In the present exemplary embodiment, when the sheet processing apparatus 1 is set in the stack mode, the regulating members 101 and 102 are positioned at the regulating positions H. Further, when the sheet processing apparatus 1 is set in the stapling process mode, the regulating members 101 and 102 are positioned at the retracting positions R. Therefore, when conveying a sheet to the joggers 51 and 52 in the stapling process mode, the regulating members 101 and 102 can be prevented from contacting the sheet.

In other words, the retracting positions R are positions at which the regulating members 101 and 102 do not contact the sheet conveyed to the joggers 51 and 52. Thus, the sheet can be favorably conveyed to the joggers 51 and 52 without being deterred by the regulating members 101 and 102, maintaining the sheet stacking performance of the joggers 51 and 52.

The regulating member 102 is retracted by the tension spring 204 in this way. Therefore, even if the regulating member 102 is caught by other members and does not move to the retracting position R, the extension of the tension spring 204 simply results, thus preventing damage to the regulating member 102. Since the upper discharge rollers 32 are positioned at the separation position, the full-state detection sensor levers 39 are positioned at the retracting position Ra.

Figure 13:
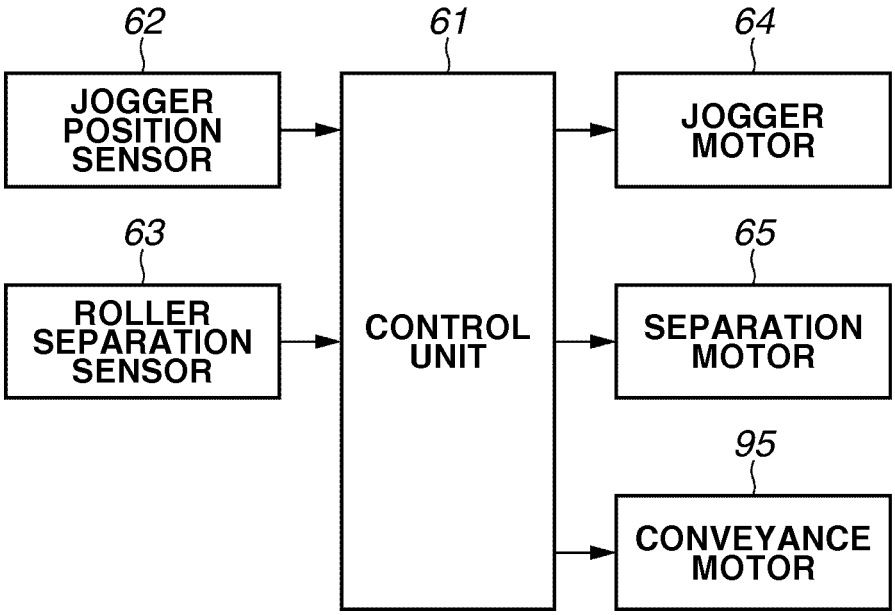
FIG. 13 is a control block diagram illustrating sensors and motors to be controlled by a control portion for controlling the sheet processing apparatus.

FIG. 13 is a control block diagram illustrating sensors and motors under control of a control portion 61 for controlling the sheet processing apparatus 1. As illustrated in FIG. 13, the control portion 61 receives detection signals from the jogger position sensor 62 and the roller separation sensor 63. The control portion 61 controls the jogger motor 64 of the drive unit 60 to move the joggers 51 and 52, and controls the separation motor 65 to move the upper discharge rollers 32, and controls the conveyance motor 95 to rotate an intermediate conveyance rollers 31 and the pairs of discharge rollers 32 and 33.

The control portion 61 receives sheet size information output from an operation portion (not illustrated) or an external computer (not illustrated). It may also be possible that the sheet processing apparatus 1 includes a sheet size detection portion (not illustrated) and the control portion 61 inputs sheet size information detected by the sheet size detection portion.

Further, the control portion 61 receives a mode setting signal from the operation portion (not illustrated) or a mode setting signal from the external computer (not illustrated), and sets either the stapling process mode or the stack mode.

Operations of the sheet processing apparatus 1 when it is set in the stapling process mode will be described in detail below.

Figure 14:
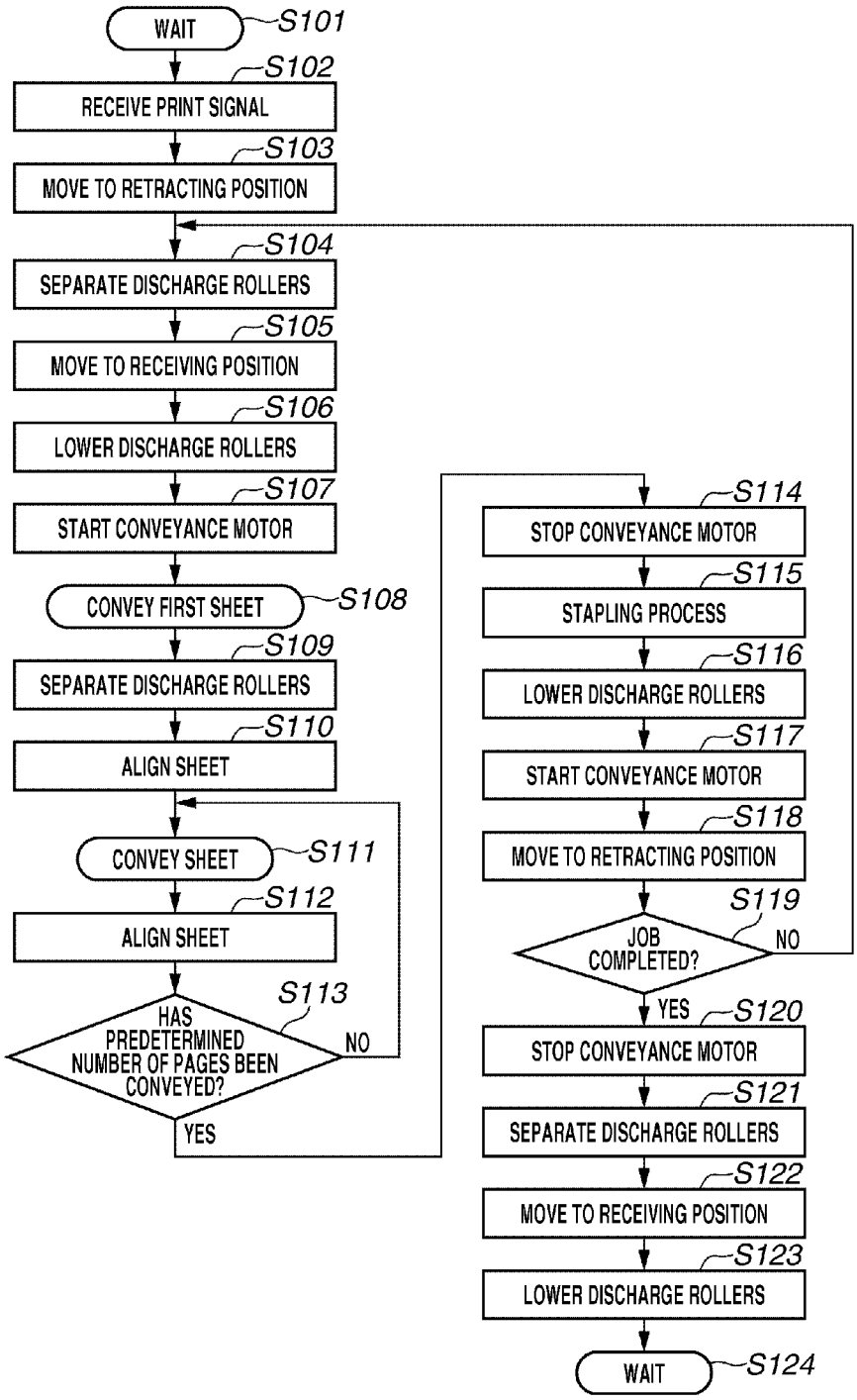
FIG. 14 is a flow chart illustrating operations of the sheet processing apparatus when it is set in the stapling process mode.

FIG. 14 is a flow chart illustrating operations of the sheet processing apparatus 1 set in the stapling process mode. In the wait state (step S101), the joggers 51 and 52 are set at the receiving positions as illustrated in FIG. 4B. When the control portion 61 receives a print signal from the copying machine main body 100A in step S102, the control portion 61 starts the jogger motor 64 to move the joggers 51 and 52 to the retracting positions (FIG. 4D) based on a detection signal from the jogger position sensor 62 in step S103.

Subsequently, when the joggers 51 and 52 are moved to the receiving positions (FIG. 4B) without any measures, the joggers 51 and 52 may collide with the full-state detection sensor levers 39 depending on the positions of the full-state detection sensor levers 39. Further, when a sheet has already been stacked on the first stacking tray 35, the regulating members 101 and 102 may collide with the sheet.

In the present exemplary embodiment, therefore, at least when moving the joggers 51 and 52 closer to each other, the control portion 61 starts the separation motor 65 to move the upper discharge rollers 32 to the separation position (FIG. 12B). Thus, the full-state detection sensor levers 39 and the regulating members 101 and 102 are moved to their respective retracting positions.

Specifically, before moving the joggers 51 and 52 to the receiving positions, the control portion 61 starts the separation motor 65 to move the upper discharge rollers 32 to the separation position (FIG. 12B) based on a signal from the roller separation sensor 63 in step S104. Thus, the full-state detection sensor levers 39 and the regulating members 101 and 102 are moved to their respective retracting positions.

In step S105, the control portion 61 moves the joggers 51 and 52 inwardly in the width direction, specifically, to the receiving positions (FIG. 4B). At this timing, since the full-state detection sensor levers 39 and the regulating members 101 and 102 have moved to their respective retracting positions, the full-state detection sensor levers 39 can move to the inside of the shape of lying squarish letter U of the joggers 51 and 52, without colliding with the joggers 51 and 52 or the regulating members 101 and 102.

Further, since the regulating members 101 and 102 have moved to the retracting positions, the regulating members 101 and 102 can be prevented from colliding with a sheet on the first stacking tray 35 and causing damage to it. It is also possible to prevent the stacked sheets from being disordered.

In step S106, the control portion 61 lowers the upper discharge rollers 32 to move them from the separation position to the contact position, which is a conveyance position for sheet conveyance. In this state, the full-state detection sensor levers 39 remain in the inside of the shape of lying squarish letter U of the joggers 51 and 52, being supported by the sheet supporting surfaces 51*a* and 52*a* of the joggers 51 and 52, respectively.

The regulating members 101 and 102 are vertically suspended toward the first stacking tray 35. At this timing, when the size of sheets already stacked on the first stacking tray 35 is larger than the size of a discharged sheet, the leading ends of the regulating members 101 and 102 contact the upper surface of the sheets already stacked on the first stacking tray 35 and then the regulating members 101 and 102 stop.

On the other hand, when the size of sheets already stacked on the first stacking tray 35 is smaller than the size of a discharged sheet, the leading ends of the regulating members 101 and 102 move to the regulating positions below the upper surface of the sheets already stacked on the first stacking tray 35 and then the regulating members 101 and 102 stop.

In step S107, before the sheet is conveyed into the sheet processing apparatus main body 1A, the control portion 61 starts the conveyance motor 95 to rotate the intermediate conveyance rollers 31 and the pairs of discharge rollers 32 and 33. In step S108, the first sheet is conveyed by the sheet processing apparatus 1. Then, the sheet conveyed to the stapling conveyance path 42 by the changeover member 41 (FIG. 2) is discharged to the intermediate stacking portion 34 by the intermediate conveyance rollers 31.

In this state, since the discharge rollers 32 have moved to the contact position (conveyance position), the sheet is conveyed by the pairs of discharge rollers 32 and 33 formed like comb teeth. Therefore, even if the first sheet of the sheets to be subjected to stapling process is curled, the sheet can be reliably conveyed toward the sheet supporting surfaces 51*a* and 52*a* of the joggers 51 and 52, respectively.

During conveyance of the first sheet, after its leading end has been delivered to the joggers 51 and 52, the upper discharge rollers 32 are moved to the separation position again in step S109. The separation of the upper discharge rollers 32 is completed after the leading end of the sheet enters the entrance (end upstream in the sheet conveyance direction) of the joggers 51 and 52 and before the end downstream in the sheet conveyance direction (leading end) of the sheet contacts the regulating members 101 and 102 currently being moved to the retracting positions for the purpose of preventing damage to the leading end of the sheet.

The regulating members 101 and 102 move to the retracting positions before the first sheet supported by the pair of joggers 51 and 52 collides with the regulating members 101 and 102 in this way, thus preventing damage to the leading end of the sheet.

Further, the sheet can be prevented from being conveyed by the pairs of discharge rollers 32 and 33, so that the discharge rollers 32 and 33 do not deter the sheet movement by subsequent sheet alignment operation, even after the end upstream in the sheet conveyance direction (trailing edge) of the sheet exits the intermediate conveyance rollers 31. Therefore, the upper discharge rollers 32 are retained at the separation position until the alignment of predetermined number of sheets subjected to stapling process is completed.

When sheets have been stacked on the intermediate stacking portion 34, the joggers 51 and 52 first move to align the lateral ends of the sheets one by one in step S110. At this timing, the jogger 51 (reference side jogger) is fixed to a position where the sheet aligning surface 51*b* is positioned on the same plane as the second alignment reference wall 53.

Then, the jogger 52 (alignment side jogger) abuts the sheets to the second alignment reference wall 53 and laterally moves the sheet to the alignment position for aligning the lateral ends (FIG. 4C), thus aligning the lateral ends of the sheet.

Then, the alignment roller 36 lowers to contact the sheet surface and then rotates in a direction opposite to the sheet conveyance direction to move the sheet until it contacts the first alignment reference wall 37, thus aligning the sheet in the sheet conveyance direction.

While the upper discharge rollers 32 are retained at the separation position as mentioned above, the control portion 61 conveys the second and subsequent sheets in step S111 and then aligns them in step S112. When a predetermined number of sheets have not yet been conveyed (NO in step S113), the control portion 61 repeats similar operation. When a predetermined number of sheets have been conveyed (YES in step S113), the control portion 61 stops the conveyance motor 95 in step S114 and then drives the stapler 54 to bind the sheets in step S115.

Subsequently, the control portion 61 moves the upper discharge rollers 32 to the contact position in step S116 and then starts the conveyance motor 95 to convey the bound sheet bundle in step S117. At this timing, since the sheet bundle is supported by the joggers 51 and 52, even after the upper discharge rollers 32 are moved to the contact position, the pair of regulating members 101 and 102 is in contact with the upper surface of the sheet bundle, and has not been moved to the regulating positions.

In step S118, the control portion 61 moves the joggers 51 and 52 to the retracting positions (FIG. 4D) at which the gap between the sheet supporting surfaces 51*a* and 52*a* of the joggers 51 and 52 is wider than the sheet width. In this state, the regulating members 101 and 102 above the sheet stack do not contribute to the regulation of the lateral ends of the sheet stack. However, since the sheet bundle is bound by the stapling process, the sheet bundle is favorably discharged and stacked on the first stacking tray 35 without disorder of any sheet in the sheet bundle.

Operations of the sheet processing apparatus 1 after the sheet bundle bound by stapling process has been discharged onto the first stacking tray 35 will be described below. The width of the second and third stacking trays 44 and 45 is set so that a sufficient number of sheets can be stacked thereon. The second and third stacking trays 44 and 45 are positioned at almost the same position as the receiving positions (FIG. 4B) of the joggers 51 and 52.

Since the receiving positions of the joggers 51 and 52 are set in such a manner that the gap therebetween is wider than the sheet width by a predetermined amount, the second and third stacking trays 44 and 45 having at least the gap of the receiving positions of the joggers 51 and 52 can sufficiently receive sheets. The tray width is made as small as possible to make it easier to take out and visually recognize the sheets stacked on the second stacking tray 44 and to miniaturize the sheet processing apparatus 1.

When performing a job in succession after completing the above-mentioned job, i.e., when processing is not completed for all jobs (NO in step S119), the control portion 61 repeats the above sequence. When processing is completed for all jobs (YES in step S119), the control portion 61 stops the conveyance motor in step S120.

Figure 15A:
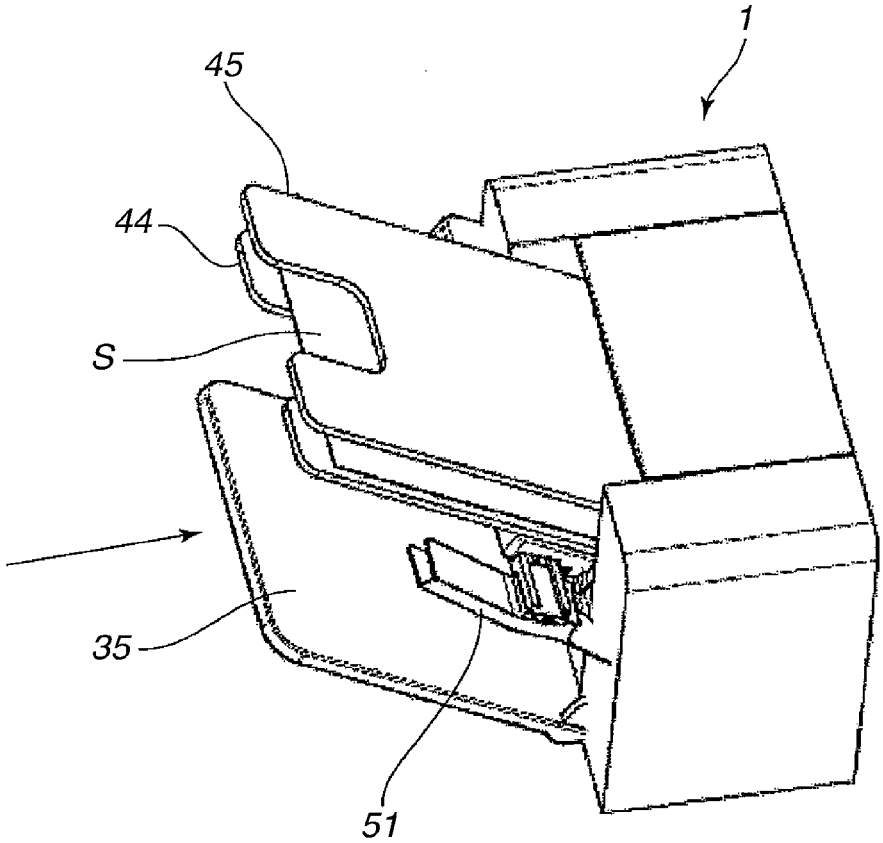
FIGS. 15A and 15B illustrate a state where the joggers have moved to passage positions.
Figure 15B:
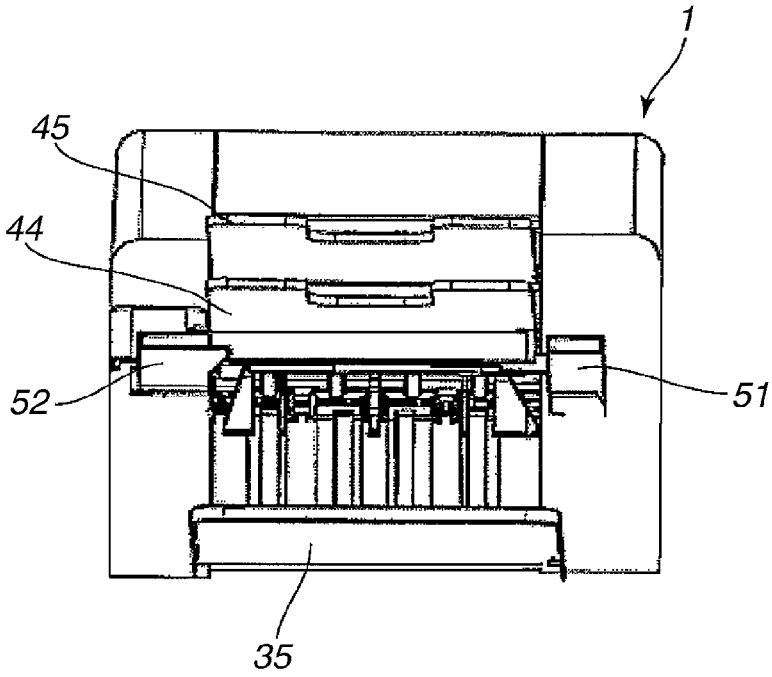

FIGS. 15A and 15B illustrate a state where the joggers 51 and 52 have moved to the retracting positions. FIG. 15A is a perspective view illustrating the sheet processing apparatus 1, and FIG. 15B is a side view illustrating the sheet processing apparatus 1 when viewed from the direction of an arrow of FIG. 15A.

The second stacking tray 44 is installed in the vicinity of the joggers 51 and 52 thereabove. Therefore, when the joggers 51 and 52 are positioned at the retracting positions (FIG. 4D), the jogger 51 protrudes anteriorly from the second stacking tray 44, as illustrated in FIGS. 15A and 15B. In this state, the jogger 51 deters the user from taking out the sheet S from the second stacking tray 44.

In the present exemplary embodiment, therefore, the control portion 61 moves the joggers 51 and 52 to the receiving positions (FIG. 4B), i.e., home positions. Specifically, similar to the case of the first sheet of the job, the control portion 61 separates the upper discharge rollers 32 in step S121, raises the full-state detection sensor levers 39 and the pair of regulating members 101 and 102, and then moves the joggers 51 and 52 to the receiving positions in step S122. Subsequently, the control portion 61 lowers the upper discharge rollers 32 in step S123 and then returns to the wait state in step S124.

Figure 16A:
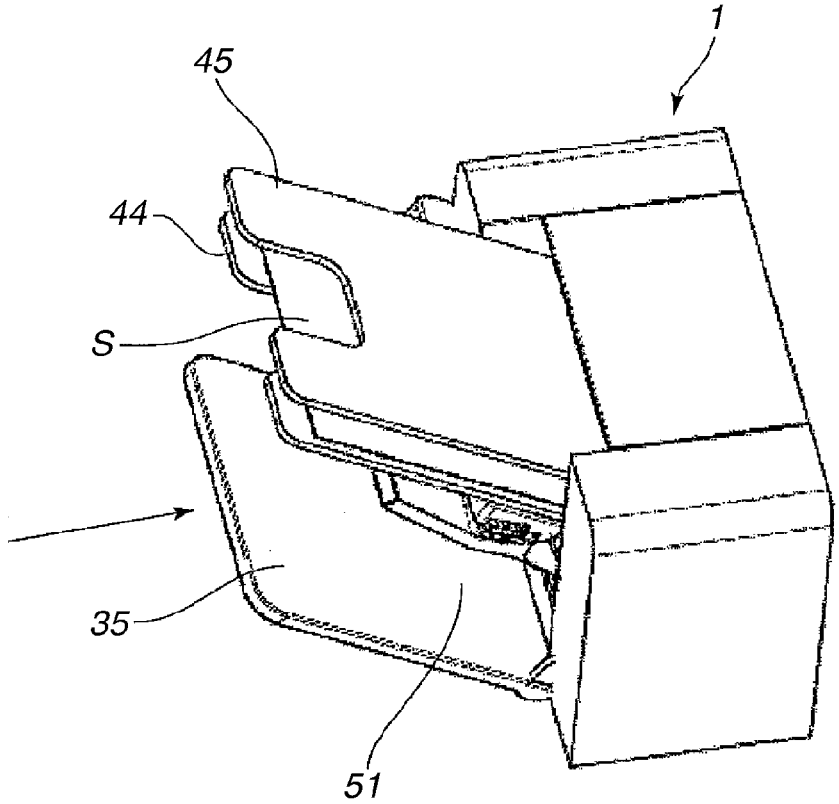
FIGS. 16A and 16B illustrate a state where the joggers have moved to receiving positions.
Figure 16B:
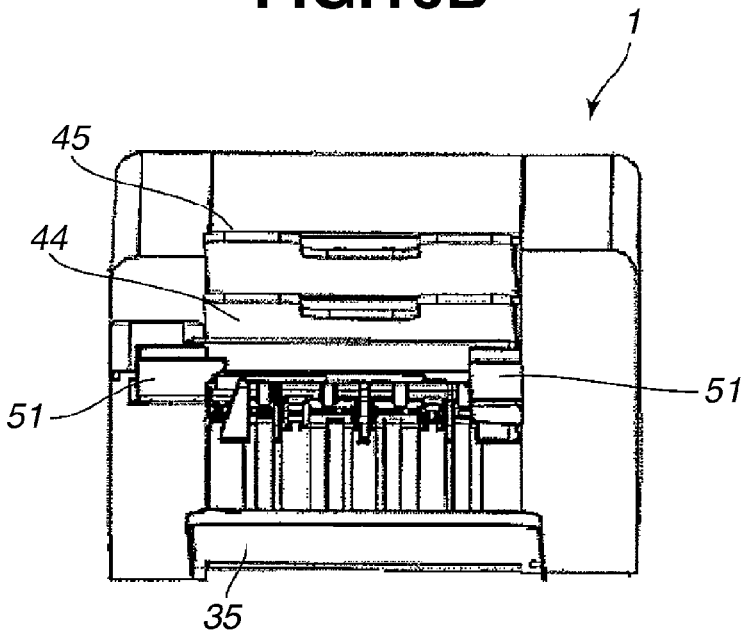

FIGS. 16A and 16B illustrate a state where the joggers 51 and 52 have moved to the receiving positions. FIG. 16A is a perspective view illustrating the sheet processing apparatus 1, and FIG. 16B is a side view illustrating the sheet processing apparatus 1 when viewed from the direction of an arrow of FIG. 16A.

As illustrated in FIGS. 16A and 16B, the jogger 51 is positioned at almost the same position as a lateral end of the second stacking tray 44, so that it is hidden under the second stacking tray 44. Accordingly, the jogger 51 (reference side jogger) does not deter the user from taking out the sheet S stacked on the second stacking tray 44, making it easier to take out the sheet S.

Using the receiving positions as home positions for the joggers 51 and 52 in this way as illustrated in FIGS. 16A and 16B makes it easier to access and visually recognize the sheets on the second stacking tray 44 in comparison with the case where the retracting positions are used as home positions as illustrated in FIGS. 15A and 15B.

Exemplary cases where sheets of one type are stacked on the first stacking tray 35 when the sheet processing apparatus 1 is set in the stack mode will be described below. Descriptions will be made for the following three different modes in this order such as the stack mode in which LTR sheets are stacked, the stapling process mode in which LTR sheets are stacked after stapling process, and the stack mode in which A5 sheets (smaller than LTR sheets) are stacked.

Figure 17C:
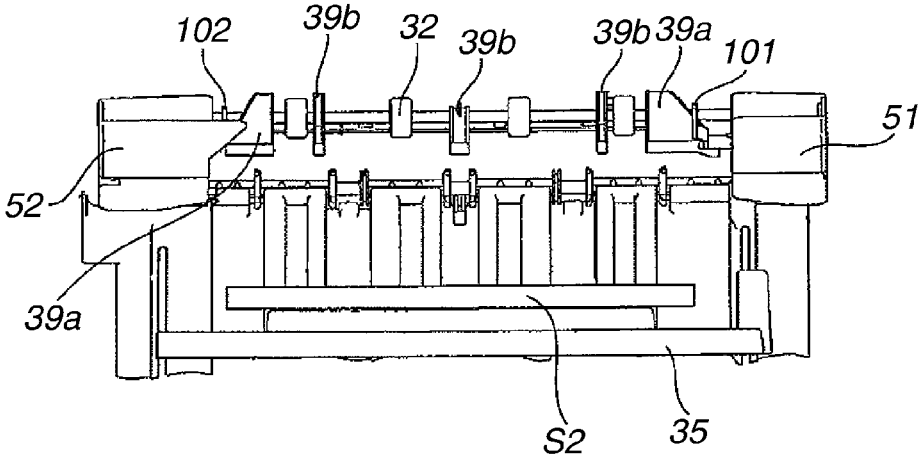

LTR sheets are of the largest size usable by the copying machine 100 according to the present exemplary embodiment. FIGS. 17A to 17C illustrate operations of the pair of regulating members 101 and 102 when the sheet processing apparatus 1 is set in the stack mode in which LTR sheets are stacked. FIG. 17A illustrates the pair of joggers 51 and 52 and the pair of regulating members 101 and 102 before a LTR sheet is discharged.

The control portion 61 controls the jogger motor 64 of the drive unit 60 to laterally move the joggers 51 and 52 to passage positions for LTR sheet size before a LTR sheet is discharged, as illustrated in FIG. 17A. By moving the joggers 51 and 52 in this way, the regulating members 101 and 102 are laterally moved to the regulating positions for regulating the lateral ends of the LTR sheet before a LTR sheet is discharged.

Specifically, the gap between the contact surfaces 101*c* and 102*c* of the regulating members 101 and 102, respectively, coincides with the lateral sheet width. In the case of LTR sheets, it coincides with the lateral width of LTR sheets. Since the upper discharge rollers 32 are positioned at the contact position, the regulating members 101 and 102 have been moved to the regulating positions H.

FIG. 17B illustrates the pair of joggers 51 and 52 and the pair of regulating members 101 and 102 in a state where a LTR sheet bundle is stacked on the first stacking tray 35. The joggers 51 and 52 have moved to the same passage positions as those of FIG. 17A.

As illustrated in FIG. 17B, since a LTR sheet S1 is conveyed on a center reference basis, it is discharged on a center reference basis by the pairs of discharge rollers 32 and 33. Then, since the pair of joggers 51 and 52 have moved to the passage positions for the LTR sheet size, the LTR sheet is directly discharged onto the first stacking tray 35.

Since the surfaces 101*a* and 102*a* of the regulating members 101 and 102 are positioned more outwardly in the width direction than the contact surfaces 101*c* and 102*c*, respectively, the surfaces 101*a* and 102*a* do not collide with the lateral ends of the LTR sheet S1 currently being discharged by the pairs of discharge rollers 32 and 33 even in the case of skew. Further, since the full-state detection sensor levers 39 are in contact with and raised by the upper surface of the LTR sheet S1 currently being discharged by the pairs of discharge rollers 32 and 33, the full-state detection sensor levers 39 do not deter the sheet discharge operation.

When the trailing edge of the LTR sheet S1 exits the pairs of discharge rollers 32 and 33, the LTR sheet S1 falls along the inclined surfaces 101*b* and 102*b* and then is guided by the contact surfaces 101*c* and 102*c*. Then, the LTR sheet S1 is stacked on the first stacking tray 35 or on the LTR sheet bundle S2 already stacked thereon, with its lateral ends being regulated by the contact surfaces 101*c* and 102*c*.

Since the lateral ends of each LTR sheet discharged are regulated by the pair of regulating members 101 and 102 in this way, the sheet lateral alignment performance of the plurality of LTR sheets stacked on the first stacking tray 35 can be improved.

Further, since the leading end portions of the regulating members 101 and 102 are vertically suspended below the sheet stacking surface 35*a* of the first stacking tray 35, the lateral ends of even the first sheet can be reliably regulated. Further, since the full state is detected by the full-state detection sensor levers 39*a* disposed most outwardly among the plurality of full-state detection sensor levers 39, the full state can be detected effectively even if a lateral end of sheets is curled.

FIG. 17C illustrates the pair of joggers 51 and 52 and the pair of regulating members 101 and 102 after all LTR sheets have been stacked on the first stacking tray 35.

When all LTR sheets have been stacked, it is necessary to move the joggers 51 and 52 to the receiving positions in advance before a sheet is conveyed in the following stapling process mode. Then, when moving the joggers 51 and 52 from the passage positions for the stack mode to the receiving positions, it is necessary to move the joggers 51 and 52 inwardly in the width direction.

In the present exemplary embodiment, therefore, the full-state detection sensor levers 39 are moved at the retracting position Ra (FIG. 12B) since the full-state detection sensor levers 39 positioned at the detecting position Ha (FIG. 12A) will collide with the joggers 51 and 52. Further, to avoid that the regulating members 101 and 102 contact the sheets on the first stacking tray 35, the regulating members 101 and 102 are retracted to the retracting positions R (FIG. 12B).

In the present exemplary embodiment, both the full-state detection sensor levers 39 and the regulating members 101 and 102 are moved in association with the separation operation of the upper discharge rollers 32. Therefore, the control portion 61 controls the separation motor 65 to move the upper discharge rollers 32 to the separation position, enabling the full-state detection sensor levers 39 and the regulating members 101 and 102 to be moved to their respective retracting positions.

Subsequently, the control portion 61 controls the jogger motor 64 of the drive unit 60 to move the joggers 51 and 52 inwardly in the width direction. Accordingly, the full-state detection sensor levers 39*a* disposed most outwardly among the plurality of full-state detection sensor levers 39 are stored in the joggers 51 and 52.

Since the regulating members 101 and 102 have moved to the retracting positions, the joggers 51 and 52 can be prevented from contacting the sheets on the first stacking tray 35 when the joggers 51 and 52 are moved inwardly in the width direction.

Figure 18A:
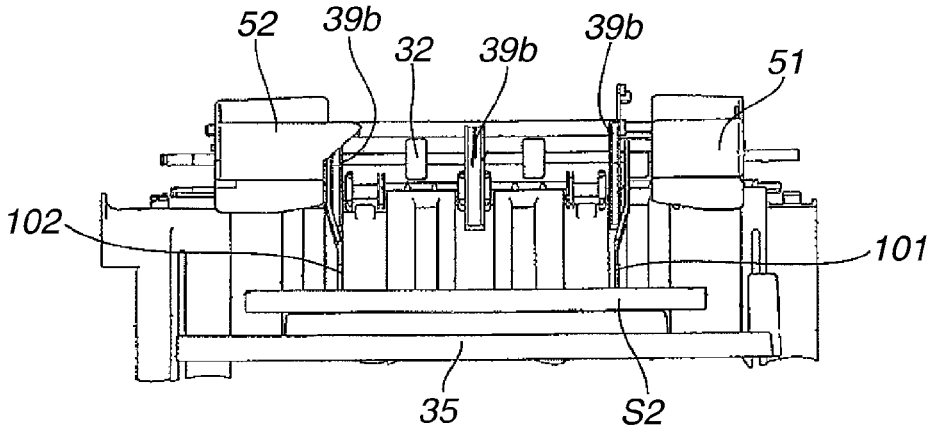
FIGS. 18A to 18C illustrate operations of the pair of regulating members when the sheet processing apparatus is set in the stapling process mode in which LTR sheets are subjected to stapling process and stacked.
Figure 18B:
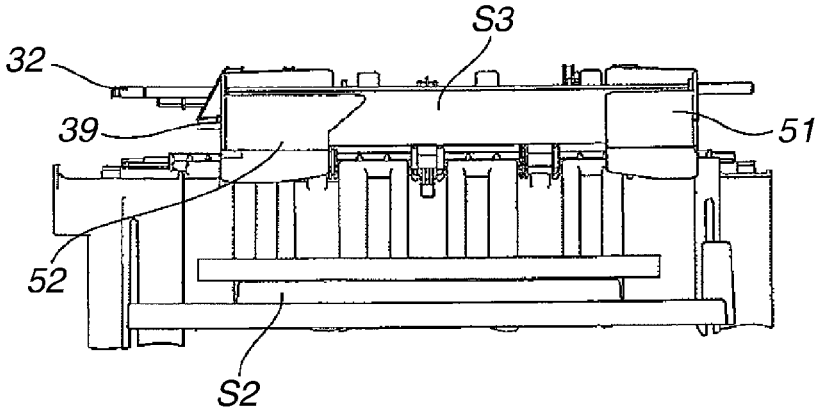
Figure 18C:
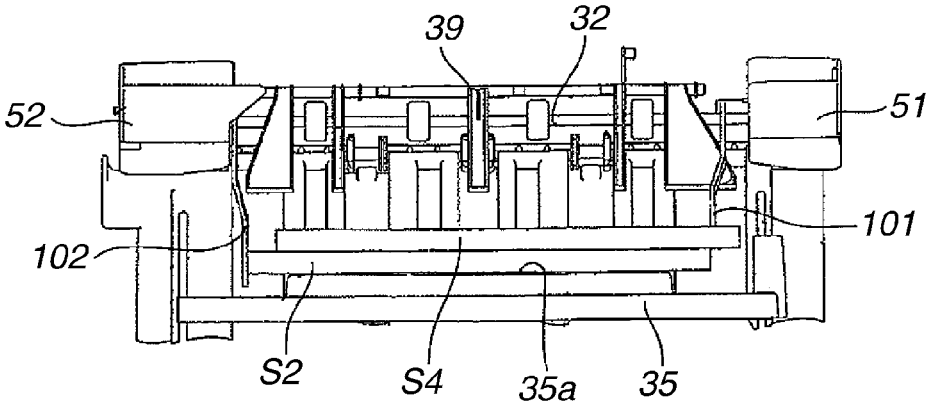

FIGS. 18A to 18C illustrate operations of the pair of regulating members 101 and 102 when the sheet processing apparatus 1 is set in the stapling process mode in which LTR sheets are subjected to stapling process and stacked.

FIG. 18A illustrates the pair of joggers 51 and 52 and the pair of regulating members 101 and 102 when the pair of joggers 51 and 52 has been moved to the receiving positions for receiving LTR sheets. As illustrated in FIG. 18A, the discharge rollers 32 have been moved to the contact position before a first LTR sheet is discharged.

This enables the pairs of discharge rollers 32 and 33 formed like comb teeth to reliably guide the first LTR sheet into the jogger 51 and 52 even if the first LTR sheet is curled. At this timing, since the upper discharge rollers 32 are positioned at the contact position, the regulating members 101 and 102 are positioned at the regulating positions, i.e., in contact with the upper surface of the LTR sheets stacked on the first stacking tray 35.

Further, since the full-state detection sensor levers 39*a* among the plurality of full-state detection sensor levers 39 are stored in the joggers 51 and 52 as mentioned above, the full-state detection sensor levers 39*a* do not return to the detecting position even after the upper discharge rollers 32 move to the contact position. Referring to FIG. 18A, the full-state detection sensor levers 39*b* have been moved to the detecting position enabling detection of the full state of sheets.

FIG. 18B illustrates a state where the pair of joggers 51 and 52 have been moved to the alignment positions for aligning LTR sheets. Before the first LTR sheet contacts the regulating members 101 and 102, the regulating members 101 and 102 have moved to the retracting positions in association with the movement of the upper discharge rollers 32 to the separation position.

Thus, a LTR sheet S3 is favorably conveyed to the pair of joggers 51 and 52. Then, the LTR sheet S3 conveyed on a center reference basis is laterally aligned on a side alignment basis by the pair of joggers 51 and 52. When the number of LTR sheets S3 stacked on the joggers 51 and 52 reaches a predetermined number, stapling process is performed.

FIG. 18C illustrates the pair of joggers 51 and 52 and the pair of regulating members 101 and 102 after the pair of joggers 51 and 52 has been moved to the retracting positions for dropping a LTR sheet bundle. After performing stapling process to the sheet bundle, the upper discharge rollers 32 are moved to the contact position to discharge the sheet bundle from the sheet processing apparatus main body 1A. At this timing, since the sheet bundle has not yet fallen, the pair of regulating members 101 and 102 is in contact with the upper surface of the sheet bundle, not vertically suspended toward the first stacking tray 35.

Subsequently, when the joggers 51 and 52 are moved to the retracting positions as illustrated in FIG. 18C, a sheet bundle S4 falls and the full-state detection sensor levers 39 and the regulating members 101 and 102 are vertically suspended toward the first stacking tray 35. Since the LTR sheet bundle S4 is aligned on a side alignment basis and falls as it is, it is stacked at a position laterally shifted from the LTR sheet bundle S2 stacked on the first stacking tray 35 on a center reference basis in the last stack mode.

In this state, the regulating members 101 and 102 do not contribute to the lateral regulation of the sheet bundle S4, and the regulating member 101 is in contact with the upper surface of the sheet bundle S4. The regulating member 102 is vertically suspended below the sheet stacking surface 35*a* of the first stacking tray 35. However, although the regulating member 102 may slightly contact the upper surface of the LTR sheet bundle S2 due to disorder of the LTR sheet bundle S2 stacked first, there is no problem with subsequent operations.

Figure 19A:
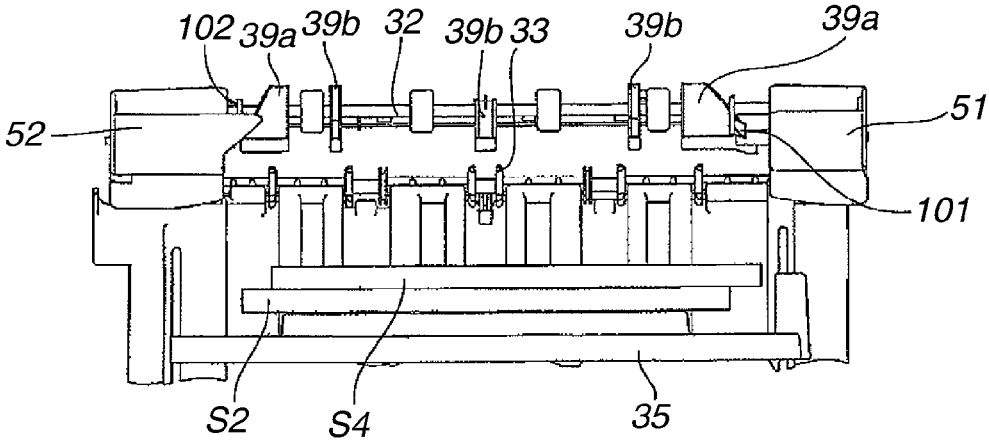
FIGS. 19A to 19C illustrate operations of the pair of regulating members when the sheet processing apparatus is set in the stack mode in which A5 sheets are stacked.
Figure 19B:
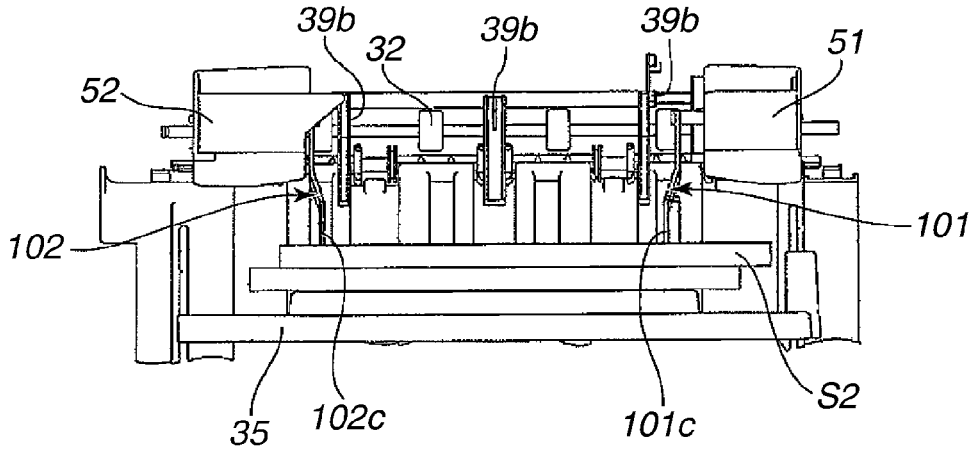
Figure 19C:
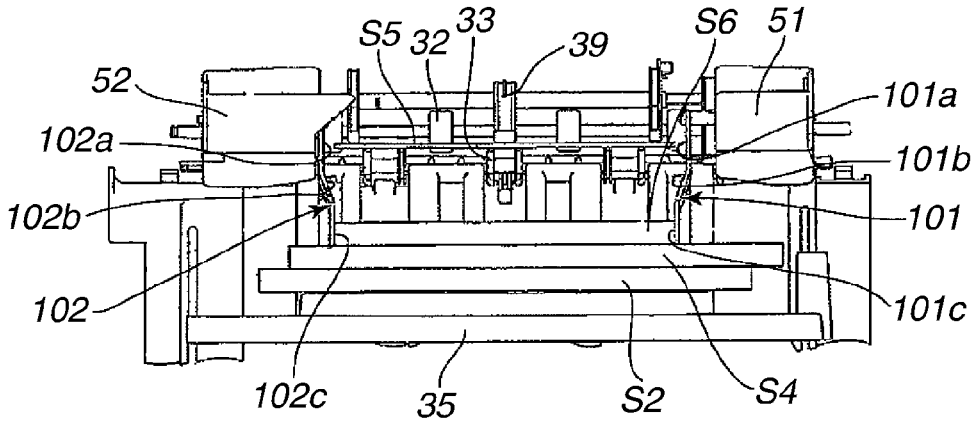

FIGS. 19A to 19C illustrate operations of the pair of regulating members 101 and 102 when the sheet processing apparatus 1 is set in the stack mode in which A5 sheets are stacked. Operations in the stack mode in which A5 sheets are stacked are almost the same as operations in the stack mode in which LTR sheets are stacked, with different amount of movement of the joggers 51 and 52.

FIG. 19A illustrates the pair of joggers 51 and 52 and the pair of regulating members 101 and 102 after the LTR sheet bundle S4 has been stacked on the first stacking tray 35. When moving the joggers 51 and 52 from the passage positions for LTR sheet size to the passage positions for A5 sheet size, it is necessary to move the joggers 51 and 52 inwardly in the width direction.

In this case, the full-state detection sensor levers 39 are moved to the retracting position Ra (FIG. 12B) since the full-state detection sensor levers 39 positioned at the detecting position Ha (FIG. 12A) will collide with the joggers 51 and 52. Further, to avoid that the regulating members 101 and 102 contact the sheets on the first stacking tray 35, the regulating members 101 and 102 are retracted to the retracting positions R (FIG. 12B).

In the present exemplary embodiment, both the full-state detection sensor levers 39 and the regulating members 101 and 102 are moved in association with the separation operation of the upper discharge rollers 32. Therefore, the control portion 61 controls the separation motor 65 to move the upper discharge rollers 32 to the separation position, enabling the full-state detection sensor levers 39 and the regulating members 101 and 102 to be moved to their respective retracting positions. Since the regulating members 101 and 102 have moved to the retracting positions, the joggers 51 and 52 can be prevented from contacting the sheets on the first stacking tray 35 when the joggers 51 and 52 are moved inwardly in the width direction.

FIG. 19B illustrates a state where the pair of joggers 51 and 52 has been moved to the passage positions for dropping a A5 sheet. The control portion 61 controls the jogger motor 64 of the drive unit 60 to laterally move the joggers 51 and 52 to the passage positions for A5 sheet size before a A5 sheet is discharged, as illustrated in FIG. 19A.

In this state, the joggers 51 and 52 have moved more inwardly in the width direction than the passage positions for enabling passage of the LTR sheet. By moving the joggers 51 and 52 in this way, the regulating members 101 and 102 are laterally moved to the regulating positions for regulating the lateral ends of the A5 sheet before the A5 sheet is discharged. Specifically, the gap between the contact surfaces 101*c* and 102*c* of the regulating members 101 and 102, respectively, coincides with the lateral sheet width. In the case of A5 sheets, it coincides with the lateral width of A5 sheets.

Further, since the full-state detection sensor levers 39*a* among the plurality of full-state detection sensor levers 39 are stored in the joggers 51 and 52, the full-state detection sensor levers 39*a* do not return to the detecting position even after the upper discharge rollers 32 move to the contact position. Referring to FIG. 19B, the full-state detection sensor levers 39*b* have been moved to the detecting position enabling detection of the full state of small-size sheets.

Further, since a sheet stacked on the first stacking tray 35 may have a curled lateral end, the full-state detection sensor levers 39*b* can detect the full-state of curled sheets stacked thereon.

FIG. 19C illustrates the pair of joggers 51 and 52 and the pair of regulating members 101 and 102 in a state where A5 sheets are stacked on the first stacking tray 35. The joggers 51 and 52 have moved to the same passage positions as those of FIG. 19B.

As illustrated in FIG. 19C, since an A5 sheet S5 is conveyed on a center reference basis, it is discharged on a center reference basis by the pairs of discharge rollers 32 and 33. Then, since the pair of joggers 51 and 52 has moved to the passage positions for A5 sheet size, the A5 sheet is directly discharged onto the first stacking tray 35 (onto the LTR sheet bundle S4).

Since the surfaces 101*a* and 102*a* of the regulating members 101 and 102 are positioned more outwardly in the width direction than the contact surfaces 101*c* and 102*c* thereof, respectively, the surfaces 101*a* and 102*a* do not collide with the lateral ends of the A5 sheet S5 currently being discharged by the pairs of discharge rollers 32 and 33 even in the case of skew. Further, since the full-state detection sensor levers 39 are in contact with and raised by the upper surface of the A5 sheet S5 currently being discharged by the pairs of discharge rollers 32 and 33, the full-state detection sensor levers 39 do not deter the sheet discharge operation.

When the trailing edge of the A5 sheet S5 exits the pairs of discharge rollers 32 and 33, the A5 sheet S5 falls along the inclined surfaces 101*b* and 102*b* and then is guided by the contact surfaces 101*c* and 102*c*. Then, the A5 sheet S5 is stacked on the LTR sheet bundle S4 on the first stacking tray 35 or on a A5 sheet S6 already stacked thereon, with its lateral ends being regulated by the contact surfaces 101*c* and 102*c*.

Since the lateral ends of each A5 sheet discharged are regulated by the pair of regulating members 101 and 102 in this way, the sheet lateral alignment performance of the plurality of A5 sheets stacked on the first stacking tray 35 can be improved.

The regulating members 101 and 102 may be moved to the retracting positions so that they do not deter the user from accessing the first stacking tray 35.

Although the first exemplary embodiment has specifically been described based on a case where five full-state detection sensor levers are laterally provided, a second exemplary embodiment will be described based on a case where a pair of full-state detection sensor levers laterally moving together with the joggers 51 and 52 is provided. In the second exemplary embodiment, elements equivalent to those in the first exemplary embodiment are assigned the same reference numerals and duplicated explanations will be omitted.

Figure 20:
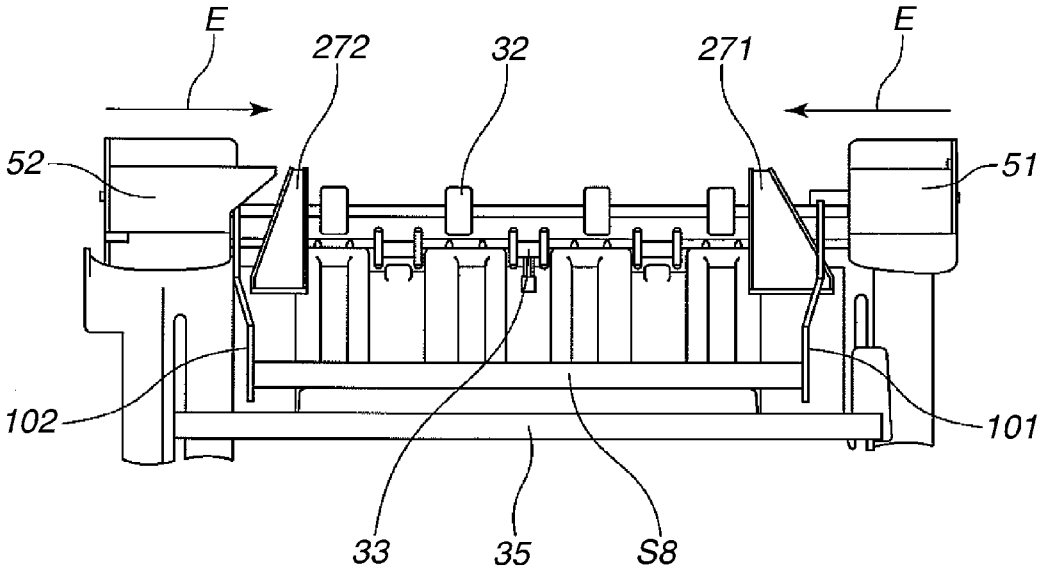
FIG. 20 illustrates an essential part of a sheet processing apparatus of a copying machine according to a second exemplary embodiment of the present invention, in a state where LTR sheets are stacked.
Figure 21:
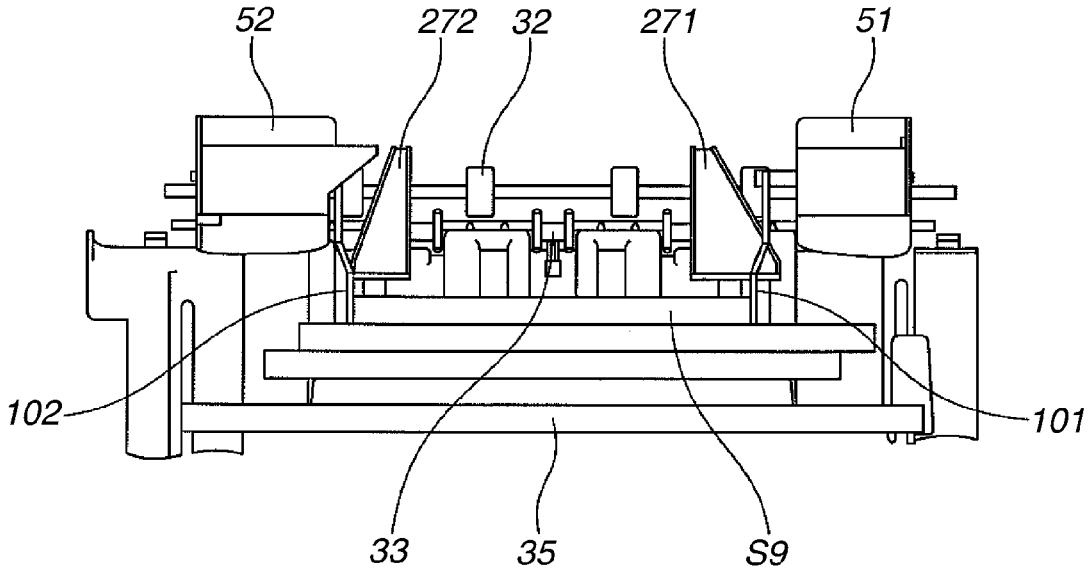
FIG. 21 illustrates the essential part of the sheet processing apparatus of the copying machine according to the second exemplary embodiment of the present invention, in a state where A5 sheets are stacked.

FIG. 20 illustrates an essential part of a sheet processing apparatus of a copying machine according to the second exemplary embodiment of the present invention, in a state where LTR sheets are stacked. FIG. 21 illustrates the essential part of the sheet processing apparatus of the copying machine according to the second exemplary embodiment of the present invention, in a state where A5 sheets are stacked.

Referring to FIG. 20, a sheet bundle S8 on the first stacking tray 35 is a stack of LTR sheets without stapling process. Referring to FIG. 21, a sheet bundle S9 on the first stacking tray 35 is a stack of A5 sheets without stapling process.

In the second exemplary embodiment, the sheet processing apparatus of the copying machine is provided with a pair of full-state detection sensor levers 271 and 272 as a pair of full-state detection members. The pair of full-state detection sensor levers 271 and 272 is rotatably supported and disposed in the vicinity of the pair of joggers 51 and 52, respectively. Specifically, the full-state detection sensor lever 271 is disposed in the vicinity of the jogger 51, and the full-state detection sensor lever 272 is disposed in the vicinity of the jogger 52.

The pair of full-state detection sensor levers 271 and 272 is supported so as to be laterally movable together with the pair of joggers 51 and 52, respectively. Specifically, the full-state detection sensor lever 271 moves together with the jogger 51, and the full-state detection sensor lever 272 moves together with the jogger 52. The full-state detection sensor levers 271 and 272 are laterally movable in the direction of an arrow E in association with the movement of the joggers 51 and 52, respectively, by a mechanism (not illustrated).

Referring to FIG. 20, the full-state detection sensor levers 271 and 272 have moved to a position for enabling detection of ends of the LTR sheet bundle S8. Referring to FIG. 21, the full-state detection sensor levers 271 and 272 have moved to a position for enabling detection of ends of the A5 sheet bundle S9.

Since the full-state detection sensor levers 271 and 272 face the lateral ends of a sheet of any size stacked on the first stacking tray 35 in this way, it is possible to detect the full state of sheets having a curled lateral end, improving the detection accuracy. Further, the lever positions are linearly movable, the full-state detection sensor levers 271 and 27 are also applicable to sheets of non-standard sizes.

Further, since the jogger 51, the full-state detection sensor lever 271, and the regulating member 101 move together, and the jogger 52, the full-state detection sensor lever 272, and the regulating member 102 move together, it is not necessary to provide a plurality of full-state detection sensor levers for each sheet size, resulting in cost reduction.

Figure 22:
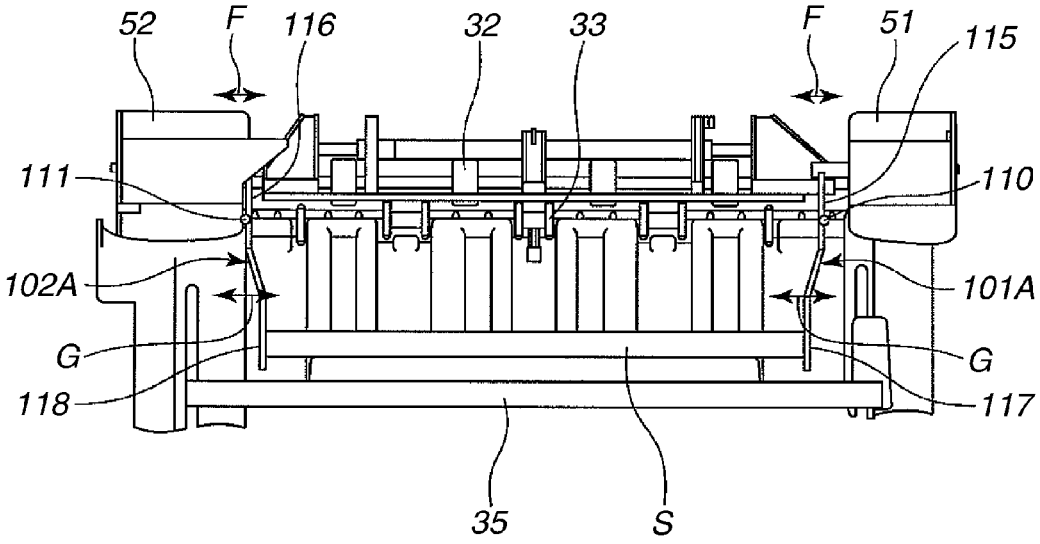
FIG. 22 illustrates an essential part of a sheet processing apparatus of a copying machine according to a third exemplary embodiment of the present invention, in a state where sheets are stacked.

A sheet processing apparatus of an image forming apparatus according to a third exemplary embodiment of the present invention will be described below. In the third exemplary embodiment, elements equivalent to those in the first exemplary embodiment are assigned the same reference numerals and duplicated explanations will be omitted. FIG. 22 illustrate an essential part of the sheet processing apparatus of the copying machine according to the third exemplary embodiment of the present invention, in a state where sheets are stacked.

As illustrated in FIG. 22, the sheet processing apparatus according to the third exemplary embodiment is provided with a pair of regulating members 101A and 102A that is laterally retractable. The pair of regulating members 101A and 102A is disposed at the pair of joggers 51 and 52, respectively.

The regulating member 101A is formed of an upper arm 115 rotatably supported in the sheet conveyance direction by the jogger 51 similar to the first exemplary embodiment, a rotational fulcrum 110 at the lower end of the upper arm 115, and a lower arm 117 laterally rotating centering on the rotational fulcrum 110.

The regulating member 102A is formed of an upper arm 116 rotatably supported in the sheet conveyance direction by the jogger 52 similar to the first exemplary embodiment, a rotational fulcrum 111 at the lower end of the upper arm 116, and a lower arm 118 laterally rotating centering on the rotational fulcrum 111.

The lower arms 117 and 118 are regulated by stoppers (not illustrated) for regulating the rotation that decreases the lateral gap therebetween. Each of the rotational fulcrums 110 and 111 is provided with a spring member (not illustrated) for inwardly biasing the lower arms 117 and 118, respectively, thus favorably regulating the lateral ends of a sheet bundle S.

When the lower arms 117 and 118 can be retained at positions for regulating the lateral ends of a sheet by their own weights, the spring members (not illustrated) can be omitted.

Figure 23:
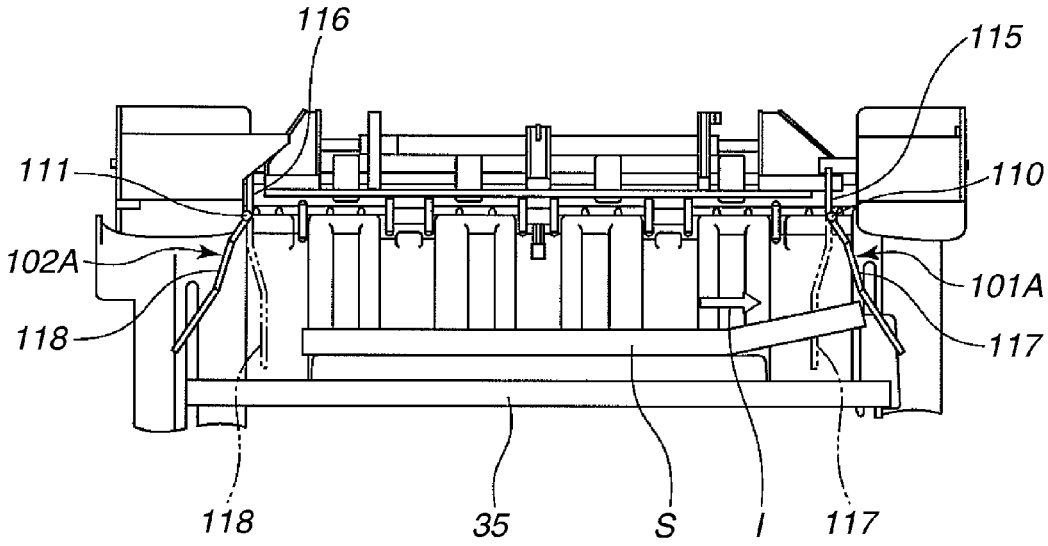
FIG. 23 illustrates a state where a user is taking out a sheet stacked from a first stacking tray.

FIG. 23 illustrates a state where the user is taking out the sheet bundle S from the first stacking tray 35. As illustrated in FIG. 23, the lower arms 117 and 118 are rotatable centering on the rotational fulcrum 110 and 111, respectively, from positions illustrated by double-dot-and-dash lines, and movable to positions illustrated by solid lines.

If the user suddenly pulls the sheet bundle S in the direction of an arrow I to take it out from the first stacking tray 35, the lower arm 117 is pushed by an end of the sheet bundle S and rotated to the position illustrated by solid lines.

Therefore, the user can take out the sheet bundle S without causing damage to the regulating member 101A resulting in improved usability. As preventive measures for damage to the regulating members, using regulating members made of an elastic material can obtain a similar effect.

In the third exemplary embodiment, as illustrated in FIG. 22, after the sheet bundle S is stacked on the first stacking tray 35 and before the subsequent sheet is discharged, the joggers 51 and 52 are minutely vibrated several times in the direction of an arrow F within a predetermined range extending inwardly from the passage positions. The predetermined range refers to a range within which the lateral ends of the subsequent sheet currently being discharged do not contact the regulating members 101A and 102A, for example, 2 mm.

The regulating members 101A and 102A supported by the joggers 51 and 52 are also minutely vibrated in the direction of an arrow G by the vibration of the joggers 51 and 52, respectively. This makes it possible to improve the sheet alignment performance of the sheet bundle S on the first stacking tray 35.

A sheet processing apparatus of an image forming apparatus according to a fourth exemplary embodiment of the present invention will be described below. In the fourth exemplary embodiment, elements equivalent to those in the first exemplary embodiment are assigned the same reference numerals and duplicated explanations will be omitted.

Figure 24:
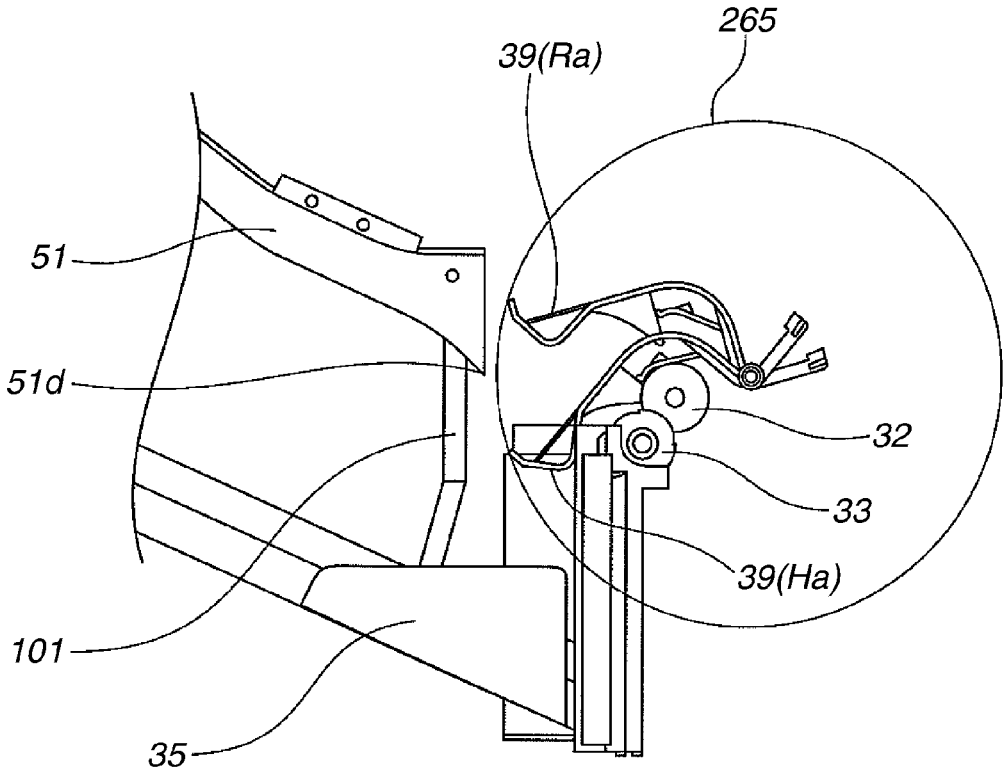
FIG. 24 is an elevational view illustrating a portion in the vicinity of a jogger of a sheet processing apparatus according to a fourth exemplary embodiment of the present invention.

FIG. 24 is an elevational view illustrating a portion in the vicinity of the jogger 51 of the sheet processing apparatus according to the fourth exemplary embodiment of the present invention. Referring to FIG. 24, the full-state detection sensor lever 39 is movable between the detecting position Ha and the retracting position Ra. The leading end portion of the full-state detection sensor lever 39 draws a moving locus 265.

An upstream end portion 51*d* of the jogger 51 is retracted upstream in the sheet conveyance direction so that it does not contact the full-state detection sensor lever 39, which is rotatable as illustrated by the moving locus 265, eliminating the need of storing the full-state detection sensor lever 39 into the jogger 51.

In this case, the distance between the pairs of discharge rollers 32 and 33 and the upstream end portion 51*d* of the jogger 51 is prolonged. However, by increasing the number of comb teeth of the pairs of discharge rollers 32 and 33, the rigidity of the sheet can be improved enabling the sheet to be favorably delivered to the jogger 51.

Although the above-mentioned exemplary embodiments have specifically been described based on cases of using a pair of joggers having integrally formed supporting and aligning members, the present invention is also effective for a case where aligning and supporting members are provided separately and the regulating members are movable together with the supporting members.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-177408 filed Jul. 30, 2009 and No. 2010-158043 filed Jul. 12, 2010, which are hereby incorporated by reference herein their entirety.

What is claimed is:

1. A sheet processing apparatus comprising:

a conveyance portion configured to convey a sheet;

a pair of supporting members movable, in a width direction perpendicular to a sheet conveyance direction of the conveyance portion, between a supporting position and a passage position, and configured to support an end in the width direction of the sheet conveyed by the conveying portion at the supporting position, and to not support the end in the width direction of the sheet conveyed by the conveying portion but enable passage of the sheet at the passage position;

a stacking portion disposed below the pair of supporting members, configured to stack the sheet fallen from the pair of supporting members moved from the supporting position to the passage position, and to stack the sheet conveyed by the conveying portion and passed between the pair of supporting members positioned at the passage position; and a pair of regulating members one end of which is rotatably supported by the pair of supporting members and other end of which is vertically suspended toward the stacking portion, disposed between the stacking portion and the pair of the supporting members, and configured to regulate the end in the width direction of the sheet conveyed by the conveying portion and passed between the pair of supporting members positioned at the passage position.

2. A sheet processing apparatus comprising:

a conveyance portion configured to convey a sheet;

a pair of aligning members movable, in a width direction perpendicular to a sheet conveyance direction of the conveyance portion, between an alignment position and a passage position, and configured to support and align an end in the width direction of the sheet conveyed by the conveying portion at the alignment position, and to neither support nor align the end in the width direction of the sheet conveyed by the conveying portion but enable passage of the sheet;

a stacking portion disposed below the pair of aligning members, configured to stack the sheet fallen from the pair of aligning members moved from the alignment position to the passage position, and to stack the sheet conveyed by the conveying portion and passed between the pair of aligning members positioned at the passage position; and a pair of regulating members, one end of which is rotatably supported by the pair of aligning members and other end of which is vertically suspended toward the stacking portion, disposed between the stacking portion and the pair of the aligning members, and configured to regulate the end in the width direction of the sheet conveyed by the conveying portion and passed between the pair of aligning members positioned at the passage position.

3. The sheet processing apparatus according to claim 2, wherein the pair of regulating members moves to a regulating position for regulating the ends in the width direction of the sheet according to a length in the width direction of the sheet to be conveyed in association with a movement of the pair of aligning members to the passage position according to the length in the width direction of the sheet to be conveyed.

4. The sheet processing apparatus according to claim 2, wherein the pair of regulating members is rotatably supported by the pair of aligning members, and movable to regulating position for regulating the ends in the width direction of the sheet and to a retracting position from the regulating position by being rotated when the pair of aligning members moves closer to each other in the width direction.

5. The sheet processing apparatus according to claim 4, further comprising:

a pair of discharge rollers disposed upstream in the conveyance direction of the pair of aligning members to enable discharging a sheet from the sheet processing apparatus main body;

a motor configured to drive the pair of discharge rollers away from each other; and a movement mechanism driven by the motor, and configured to move the pair of regulating members from the regulating position to the retracting position in association with a separation operation of the pair of discharge rollers.

6. The sheet processing apparatus according to claim 2, wherein the stacking portion is provided with a sheet stacking surface having a length in the width direction smaller than the minimum length in the width direction of the sheet to be used, in a case where no sheet is stacked on the sheet stacking surface when the pair of regulating members has moved to the regulating position, the regulating members are vertically suspended below the sheet stacking surface.

7. The sheet processing apparatus according to claim 2, further comprising:

a plurality of detection members arranged along the width direction in such a manner that they are independently rotatable to each other so as to intersect a moving region of the pair of aligning members, and configured to contact an upper surface of stacked sheets to detect a full state, wherein, when the pair of aligning members is moved closer to each other in the width direction, the plurality of detection members rotates to a position for avoiding collision with the pair of aligning members.

8. The sheet processing apparatus according to claim 2, further comprising:

a pair of detection members disposed in a vicinity of the pair of aligning members and rotatably supported so that the pair of detection members are movable together with the pair of aligning members in the width direction, and configured to contact an upper surface of the stacked sheets to detect a full state.

9. The sheet processing apparatus according to claim 2, wherein each of the pair of regulating members has an inclined surface extending toward the stacking portion while being inclined inwardly in the width direction, and a contact surface vertically extended from the inclined surface toward the stacking portion to contact an end in the width direction of the sheet.

10. The sheet processing apparatus according to claim 2, wherein the pair of regulating members is retractable in the width direction.

11. The sheet processing apparatus according to claim 2, wherein the sheet processing apparatus is selectively set in a processing mode in which the pair of aligning members is moved to the alignment position to align the ends in the width direction of the sheet, the sheet is processed, and the pair of aligning members is moved to the passage position to stack the sheet on the stacking portion, and in a stack mode in which the pair of aligning members is moved to the passage position to stack the sheet directly on the stacking portion.

12. The sheet processing apparatus according to claim 11, wherein in the processing mode, the sheet is stacked on the stacking portion on a side alignment basis with reference to one end in the width direction of the sheet, and in the stack mode, the sheet is stacked on the stacking portion on a center reference basis with reference to a center in the width direction of the sheet.

13. An image forming apparatus comprising:

an image forming portion configured to form an image on a sheet;

a conveyance portion configured to convey a sheet having thereon the image formed by the image forming portion;

a pair of supporting members movable, in a width direction perpendicular to the sheet conveyance direction of the conveyance portion, between a supporting position and a passage position, and configured to support an end in the width direction of the sheet conveyed by the conveying portion at the supporting position, and to not support the end in the width direction of the sheet conveyed by the conveying portion but enable passage of the sheet at the passage position;

a stacking portion disposed below the pair of supporting members, configured to stack the sheet fallen from the pair of supporting members moved from the supporting position to the passage position, and to stack the sheet conveyed by the conveying portion and passed between the pair of supporting members positioned at the passage position; and a pair of regulating members one end of which is rotatably supported by the pair of supporting members and other end of which is vertically suspended toward the stacking portion, disposed between the stacking portion and the pair of the supporting members, and configured to regulate the end in the width direction of the sheet conveyed by the conveying portion and passed between the pair of supporting members positioned at the passage position.

14. An image forming apparatus comprising:

an image forming portion configured to form an image on a sheet;

a conveyance portion configured to convey the sheet having thereon the image formed by the image forming portion;

a pair of aligning members movable, in a width direction perpendicular to the sheet conveyance direction of the conveyance portion, between an alignment position and a passage position, and configured to support and align an end in the width direction of the sheet conveyed by the conveying portion at the alignment position, and to neither support nor align the end in the width direction of the sheet conveyed by the conveying portion but enable passage of the sheet;

a stacking portion disposed below the pair of aligning members, configured to stack the sheet fallen from the pair of aligning members moved from the alignment position to the passage position, and to stack the sheet conveyed by the conveying portion and passed between the pair of aligning members positioned at the passage position; and a pair of regulating members, one end of which is rotatably supported by the pair of aligning members and other end of which is vertically suspended toward the stacking portion, disposed between the stacking portion and the pair of the aligning members, and configured to regulate the end in the width direction of the sheet conveyed by the conveying portion and passed between the pair of aligning members positioned at the passage position.

15. The image forming apparatus according to claim 14, wherein the pair of regulating members moves to a regulating position for regulating the ends in the width direction of the sheet according to a length in the width direction of the sheet to be conveyed in association with the movement of the pair of aligning members to the passage position according to the length in the width direction of the sheet to be conveyed.

16. The image forming apparatus according to claim 14, wherein the pair of regulating members is rotatably supported by the pair of aligning members, and movable to regulating positions for regulating the ends in the width direction of the sheet and to a retracting position from the regulating position by being rotated when the pair of aligning members moves closer to each other in the width direction.

17. The image forming apparatus according to claim 16, further comprising:

a pair of discharge rollers disposed upstream in the sheet conveyance direction of the pair of aligning members to enable discharging a sheet from the apparatus main body;

a motor configured to drive the pair of discharge rollers away from each other; and a movement mechanism driven by the motor and configured to move the pair of regulating members from the regulating position to the retracting position in association with a separation operation of the pair of discharge rollers.

18. The image forming apparatus according to claim 14, wherein the stacking portion is provided with a sheet stacking surface having a length in the width direction smaller than the minimum length in the width direction of the sheet to be used, in a case where no sheet is stacked on the sheet stacking surface when the pair of regulating members has moved to the regulating position, the regulating members are vertically suspended below the sheet stacking surface.

19. The image forming apparatus according to claim 14, wherein each of the pair of regulating members has an inclined surface extending toward the stacking portion while being inclined inwardly in the width direction, and a contact surface vertically extended from the inclined surface toward the stacking portion to contact an end in the width direction of the sheet.

20. The image forming apparatus according to claim 14, wherein the pair of regulating members is retractable in the width direction.

21. The image forming apparatus according to claim 14, wherein the sheet processing apparatus is selectively set in a processing mode in which the pair of aligning members is moved to the alignment positions to align the ends in the width direction of the sheet, the sheet is processed, and the pair of aligning members is moved to the passage position to stack the sheet on the stacking portion, and in a stack mode in which the pair of aligning members is moved to the passage position to stack the sheet directly on the stacking portion.

22. The image forming apparatus according to claim 21, wherein in the processing mode, the sheet is stacked on the stacking portion on a side alignment basis with reference to one end in the width direction of the sheet, and in the stack mode, the sheet is stacked on the stacking portion on a center reference basis with reference to a center in the width direction of the sheet.

* * * * *